US011035171B2

(12) United States Patent
Pham et al.

(10) Patent No.: US 11,035,171 B2
(45) **Date of Patent: *Jun. 15, 2021**

(54) ADJUSTABLE MOUNTING SYSTEM FOR WINDOW BLINDS AND SHADES

(71) Applicant: RYSE INC., Toronto (CA)

(72) Inventors: Trung Duc Pham, Brampton (CA); Wilfrid Ngo, Mississauga (CA)

(73) Assignee: Ryse Inc., Toronto (CA)

( * ) Notice: Subject to any disclaimer, the term of this patent is extended or adjusted under 35 U.S.C. 154(b) by 289 days.

This patent is subject to a terminal disclaimer.

(21) Appl. No.: 15/934,297

(22) Filed: Mar. 23, 2018

(65) Prior Publication Data

US 2018/0209213 A1 Jul. 26, 2018

Related U.S. Application Data

(62) Division of application No. 14/934,608, filed on Nov. 6, 2015, now Pat. No. 9,926,740.

(30) Foreign Application Priority Data

Nov. 6, 2014 (CA) ..... 2870986

(51) Int. Cl.
*E06B 9/42* (2006.01)
*E06B 9/44* (2006.01)
*E06B 9/40* (2006.01)

(52) U.S. Cl.
CPC ..... *E06B 9/42* (2013.01); *E06B 9/44* (2013.01); *E06B 2009/402* (2013.01); *E06B 2009/405* (2013.01); *E06B 2009/407* (2013.01)

(58) Field of Classification Search
CPC ..... E06B 9/40; E06B 9/42; E06B 9/44; E06B 2009/402; E06B 2009/405; E06B 2009/407; E06B 2009/1713
See application file for complete search history.

(56) References Cited

U.S. PATENT DOCUMENTS 52,296 A 1/1866 Lamberson et al.
1,057,603 A * 4/1913 Whitney ..... E06B 9/90 160/301

(Continued)

FOREIGN PATENT DOCUMENTS

CA 2619787 A1 8/2009
DE 2813212 A1 9/1979

(Continued)

OTHER PUBLICATIONS

Chinese Office Action (with English translation) dated Mar. 6, 2019, issued in corresponding Chinese Application No. 201580065129.3, 5 pages.

(Continued)

*Primary Examiner* — Daniel P Cahn
*Assistant Examiner* — Abe Massad
(74) *Attorney, Agent, or Firm* — Foley & Lardner LLP

(57) ABSTRACT

A mounting system for a roller blind includes a tension bar for mounting under pressure between first and second sides of a windows frame. The tension bar may provide both long and short adjustment of mounting system width. The tension bar extends through a hollow roller tube of the roller blind, and through a clutch mechanism of the roller blind, and is coupled to end mounting fixtures. The length of the tension bar may be adjusted as a long adjustment of mounting width. Various mechanisms may be associated with one or both of the end mounting fixtures for short adjustment of mounting width, such as a latch mechanism, wedge mechanism, spring-loaded mechanism, or turn-buckle system. End pads at the ends of the blind provide friction and absorb excess pressure. The mounting mechanism serves as a universal window blind bracket and support rod, which requires no screws or nails to install.

19 Claims, 19 Drawing Sheets

(56) References Cited

U.S. PATENT DOCUMENTS

| | | | | |
|---|---|---|---|---|
| 1,238,642 | A | 8/1917 | Crump | |
| 4,712,599 | A * | 12/1987 | Komaki | E06B 9/165 160/133 |
| 4,865,109 | A | 9/1989 | Sherman | |
| 5,676,415 | A | 10/1997 | Ament et al. | |
| 5,868,191 | A * | 2/1999 | Blackmon, Jr. | A47H 21/00 160/237 |
| 5,881,793 | A | 3/1999 | Righter et al. | |
| 6,460,593 | B1 | 10/2002 | Floyd | |
| 7,128,124 | B2 | 10/2006 | Bibby et al. | |
| 7,549,615 | B2 | 6/2009 | Shevick | |
| 7,621,313 | B2 | 11/2009 | Pham | |
| 7,665,505 | B2 | 2/2010 | McCormick et al. | |
| 7,854,419 | B2 | 12/2010 | Ng et al. | |
| 8,025,088 | B2 * | 9/2011 | Kim | E06B 9/78 160/120 |
| 8,182,381 | B2 * | 5/2012 | Gunton | E06B 9/70 474/100 |
| 8,556,059 | B2 | 10/2013 | Ng et al. | |
| 8,695,681 | B2 | 4/2014 | Daniels | |
| 8,726,972 | B1 | 5/2014 | Wills | |
| 8,839,841 | B2 | 9/2014 | Koop et al. | |
| 8,967,568 | B2 | 3/2015 | Wills et al. | |
| 9,926,740 | B2 | 3/2018 | Pham et al. | |
| 2007/0107857 | A1 * | 5/2007 | Wang | E06B 9/78 160/321 |
| 2008/0230185 | A1 | 9/2008 | Kahn | |
| 2008/0245940 | A1 | 10/2008 | Brown | |
| 2009/0242143 | A1 | 10/2009 | Pham | |
| 2012/0037321 | A1 | 2/2012 | Pham | |
| 2012/0228906 | A1 | 9/2012 | McAndrews et al. | |
| 2013/0105649 | A1 | 5/2013 | Wills et al. | |
| 2014/0014279 | A1 | 1/2014 | Defenbaugh et al. | |
| 2014/0190642 | A1 | 7/2014 | Chou | |
| 2015/0225997 | A1 | 8/2015 | Soper | |
| 2015/0330145 | A1 | 11/2015 | Lewis | |

FOREIGN PATENT DOCUMENTS

| | | | |
|---|---|---|---|
| EP | 0712757 | A1 | 5/1996 |
| EP | 1353037 | A2 | 10/2003 |
| WO | 2014197253 | A2 | 12/2014 |

OTHER PUBLICATIONS

Chinese First Office Action issued in Chinese Application No. 201910551076.6 dated Mar. 27, 2020, with English Translation.

International Search Report and Written Opinion dated Jan. 18, 2016, issued in corresponding International Patent Application No. PCT/CA2015/051139, 7 pages.

European Examination Report, dated Sep. 9, 2019, issued in corresponding European Application No. 15 856 877.4, 5 pages.

Supplementary European Search Report, dated Jun. 20, 2018, issued in corresponding European Application No. EP 15 856 877, 9 pages.

Chinese Office Action (with English Translation), dated Jul. 30, 2018, issued in corresponding Chinese Application No. 2015800651293, 11 pages.

* cited by examiner

ADJUSTABLE MOUNTING SYSTEM FOR WINDOW BLINDS AND SHADES

CROSS-REFERENCE TO RELATED APPLICATIONS

This application is a divisional of Non-Provisional patent application Ser. No. 14/934,608, filed Nov. 6, 2015, entitled "Adjustable Mounting System for Window Blinds and Shades", which claims priority to Canadian Patent Application No. 2,870,986, filed Nov. 6, 2014, the entirety of which are incorporated by reference as if fully set forth herein.

TECHNICAL FIELD

The present disclosure relates to a window blinds and shades, and more particular to adjustable systems for mounting window blinds and shades within architectural openings.

BACKGROUND

Various blinds are known for selectively covering architectural openings. Many of these include rollers that are rotatably mounted, usually in a horizontal orientation, for instance between the inner walls of an architectural opening, such as a windows recess. To facilitate installation of the roller, an arrangement may be provided whereby a pair of brackets is mounted on opposite inner walls of the architectural opening. The roller is than fitted between the two brackets.

Roller blinds are a popular form of window covering. Roller blinds generally consist of an elongated roller tube upon which the blind is wound. The roller tube has opposite ends and is generally provided with a roller clutch at one end and a plug or idler at the other end. The roller clutch includes a mechanism to raise and lower the blind by engaging a cord or chain (herein sometimes called continuous cord loop). The roller blind is mounted to a window by means of mounting brackets which secure the roller blind to the wall immediately adjacent the window or to the window frame, as the case may be. For example, one mounting arrangement involves a pair of brackets mounted on opposing inner walls of the architectural opening. The mounting brackets generally include a mounting fixture for engaging and mounting the clutch and/or the idler, depending on which end of the roller blind is being supported.

Several ways of fitting a roller between brackets are possible. For example, the ends of the roller may be provided with co-axially extending end plugs with axial holes for receiving a tab-like projection from the brackets. Alternatively the ends of the roller may be provided with co-axially extending end plugs, the end plugs being provided with axially projecting tabs for insertion into an opening in a bracket. These and other installation procedures can be burdensome, requiring careful location and mounting of the brackets and other components, and needing mounting tools and fasteners.

While the combination of a roller blind and mounting brackets is a popular window covering system, there are drawbacks with the design. Firstly, mounting the roller blind to the window (or wall adjacent the window as the case may be) requires careful measurement to ensure that the roller blind and fascia are level. If the roller blind is not exactly level, then the blind will tend to "telescope" on the roller, i.e., roll up in a slanted configuration, as it is wound up and unwound. This is not only unsightly, but it can cause roller blind malfunction. In such cases the user must re-drill the brackets that hold the casing of the blind to make it more level. This is a time consuming and tedious operation involving careful measurements and trial and error.

Additionally, many offices and some residential homes have concrete walls as window frames. This makes it very difficult for consumers to install window blinds via traditional drilling and screws. A specialized drill and installation method must be utilized in order to properly install window blinds in concrete walls.

Other window covering systems includes a bottom rail extending parallel to the headrail, and some form of shade material which might be fabric or shade or blind material, interconnecting the headrail and bottom rail. The shade or blind material is movable with the bottom rail between spread and retracted positions relative to the headrail. For example, as the bottom rail is lowered or raised relative to the headrail, the fabric or other material is spread away from the headrail or retracted toward the headrail so it can be accumulated either adjacent to or within the headrail. Such mechanisms can include various control devices, such as pull cords that hang from one or both ends of the headrail.

For the foregoing reasons, there is a need for a mounting system for window blinds and shades, such as roller blinds, that does not require burdensome installation procedures or mounting tools. There is a need for a mounting system for window blinds and shades that does not require that requires no screws or nails to install, and that can be easily installed on wall or window frame materials such as concrete. There is a need for a mounting system that simplifies leveling a window blind or shade during installation. Further, there is a need for a mounting system that provides safe, secure support for window blinds and shades.

SUMMARY

The embodiments described herein include a mounting system for a roller blind including a roller tube with a windows covering rolled around the tube, and a clutch mechanism for raising and lowering the window covering. The mounting system includes a tension bar, which provides a long and short adjustment of mounting system width for mounting under pressure between first and second sides of an architectural opening, such as a windows frame, to hold up the roller blind. The tension bar extends through a hollow roller tube of the roller blind, through a central recess in the clutch mechanism. Additionally, the tension bar may extend through an idler mechanism located at the opposite end of the roller tube from the clutch mechanism.

The length of the tension bar may be adjusted as a long adjustment. The mounting system also provides short adjustment of mounting width. Various mechanisms may be provided for short adjustment of mounting width, such as a latch mechanism, wedge mechanism, spring-loaded mechanism, or a turn-buckle system.

In one embodiment, a mounting system for a roller blind, the roller blind including a roller tube with a window covering rolled around the roller tube, and a mechanism associated with the roller tube for raising and lowering the window covering and including a first clutch and a continuous cord loop engaged by the first clutch, wherein the roller tube is hollow and the first clutch includes a central recess, comprises a first mounting fixture including a first end member mountable to a first side of a window frame; a second mounting fixture including a second end member mountable to a second side of a window frame; and a tension bar extending through the hollow roller tube and the central recess of the first clutch, and coupled to the first mounting fixture and to the second mounting fixture.

In another embodiment, a roller blind comprises a roller tube with a window covering rolled around the roller tube; a mechanism associated with the roller tube for raising and lowering the window covering including a clutch and a continuous cord loop having a loop end adjacent the clutch, wherein the roller tube is hollow and the clutch includes a central recess; a first mounting fixture including a first end member mountable to a first side of a window frame; a second mounting fixture including a second end member mountable to a second side of a window frame; and a tension bar extending through the hollow roller tube and the central recess of the first clutch, and coupled to the first mounting fixture and to the second mounting fixture.

In another embodiment, a window covering system comprises a headrail including a mechanism for extending and retracting a window covering; a clutch associated with the mechanism for extending and retracting the window covering, wherein the clutch includes a central recess; a tension bar extending through the headrail and the central recess of the clutch; a first mounting fixture including a first end member coupled to the tension bar for mounting under pressure to a first side of a window frame, wherein the first end member frictionally engages the first side of the window frame; a second mounting fixture including a second end member coupled to the tension bar for mounting under pressure to a second side of a window frame, wherein the second end member frictionally engages the second side of the window frame; and a mechanism associated with at least one of the first mounting fixture and the second mounting fixture for adjusting a width between the first end member and the second end member.

Additional features and advantages of an embodiment will be set forth in the description which follows, and in part will be apparent from the description. The objectives and other advantages of the invention will be realized and attained by the structure particularly pointed out in the exemplary embodiments in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

Non-limiting embodiments of the present disclosure are described by way of example with reference to the accompanying figures which are schematic and are not intended to be drawn to scale. Unless indicated as representing the background art, the figures represent aspects of the disclosure.

DETAILED DESCRIPTION

Figure 1:
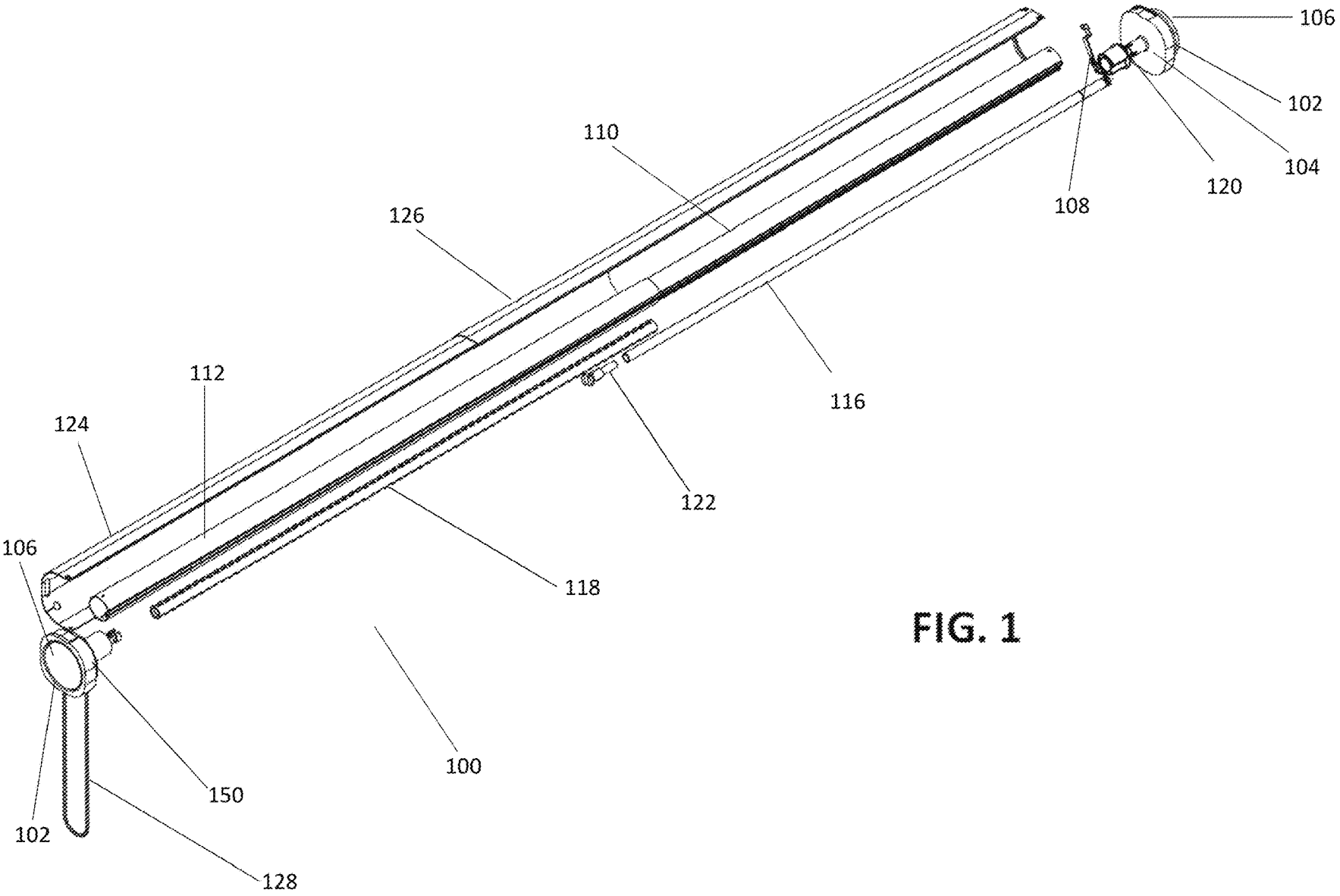
FIG. 1 is an perspective view of disassembled components, according to an embodiment.

The present disclosure is here described in detail with reference to embodiments illustrated in the drawings, which form a part here. Other embodiments may be used and/or other changes may be made without departing from the spirit or scope of the present disclosure. The illustrative embodiments described in the detailed description are not meant to be limiting of the subject matter presented here. Furthermore, the various components and embodiments described herein may be combined to form additional embodiments not expressly described, without departing from the spirit or scope of the invention.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to one skilled in the relevant art and having possession of this disclosure, are to be considered within the scope of the invention.

The present disclosure describes various embodiments of a roll-up window covering (or roller blind) system. As used in the present disclosure, a roller blind system is a system for raising and lowering a window covering including an elongated roller tube upon which the blind is wound. In the present disclosure, "window covering" includes any covering material or fabric that may be lowered or spread to cover a window or other architectural opening using a roller blind system. Window covering embodiments described herein will refer to fabric, blind or blinds, it being understood that these embodiments are illustrative of other forms of window coverings.

In another embodiment, the tension bar may extend through a headrail of a window covering system, and through a central recess in a clutch mechanism that is part of a mechanism in the headrail for extending and retracting window coverings. In this embodiment, the tension bar does not extend through a hollow roller tube.

As used in the present application, the term "window frame" also encompasses other architectural openings such as archways, and the term "casement" is sometimes used herein in lieu of "window frame". References to a "side" or to an "inner surface" of a "window frame" also encompass sides or inner surfaces of other architectural openings.

As used in the present disclosure, a "continuous cord loop" is an endless loop of flexible material, such as a rope, cord, beaded chain and ball chain Continuous cord loops in the form of loops of cord are available in various types and ranges of diameter including for example D-30 (1⅛"-1¼"), C-30 (1³⁄₁₆"-1⁷⁄₁₆"), D-40 (1³⁄₁₆"-1⁷⁄₁₆"), and K-35 (1¼"-1½"). Additionally, various types of beaded chain and ball chain are commonly used as continuous cord loops for roller blinds.

Roller blinds are generally controlled by a roller clutch assembly that is used to raise and lower the blind, manually or under motor control. These clutch assemblies generally consist of a housing having a barrel portion to which a roller tube support structure is rotatably mounted. The blind is coupled to a roller tube which is in turn coupled to the roller tube support structure. A clutch assembly is rotatably mounted to the barrel portion of the housing and is coupled to the roller tube support member. A looped cord or chain is in turn coupled to the clutch assembly to permit the user to rotate the clutch (and thereby the roller tube) by pulling on the cord. This permits the user to raise and/or lower the blind by pulling on the cord to rotate the roller tube in the desired direction.

The present disclosure provides a mounting system for a roller blind, in which a mechanism for raising and lowering a window covering rolled around a roller tube includes a clutch. The roller tube is hollow and the clutch includes a central recess, i.e., the clutch includes a hollow center. A tension bar extends through the hollow roller tube and the central recess of the clutch. As the term "extends through" is used in the present disclosure, a tension bar extends through the hollow roller tube and the central recess of the clutch either by extending completely through these structures, or by extending partially through these structures. In an alternative embodiment, a tension bar extends through a headrail and a central recess of a clutch associated with the headrail.

The mounting system includes a first mounting fixture with a first end member, and a second mounting fixture with a second end member, mountable respectively at first and second sides of a window frame. The tension bar is coupled to the first mounting fixture and the second mounting fixture.

In an embodiment, at least one of the first mounting fixture and second mounting fixture includes an adjustment mechanism for adjusting a width between the first and second end member. In an embodiment, the adjustment mechanism for adjusting a width between the first and second end member is a short adjustment mechanism for adjusting the width between the first and second end member over a short distance. In an embodiment, adjustment of the width between the first and second end member over a short distance calibrates the width of the mounting system to the width of the window frame, and adjusts the pressure exerted by the first end member and the second end member to mount the roller blind using pressure mounting.

Various embodiments of short adjustment mechanism may be employed, including for example spring-loaded mechanisms in which the mounting system exerts a substantially constant pressure against the window frame, and arrangements in which the user adjusts the width of between the first and member and second end member, and calibrates the pressure exerted by first end member and second end member against the window frame. Exemplary short adjustment mechanisms include, without limitation, short adjustment through a spring-loaded mechanism, a latch mechanism, a wedge mechanism, a sprocket mechanism, or a turn-buckle mechanism. In some embodiments, the user effects the short adjustment mechanism without tools. The short adjustment mechanism may incorporate an adjustment dial that can be adjusted manually by a user, or a system such as a worm gear system that may be adjusted using a tool. In another embodiment of a short adjustment mechanism, an end pad mounted to an adjustment sprocket is screwed onto a threaded shaft, and is tightened by a user using a tool to rotate the sprocket.

In an embodiment, a short adjustment mechanism is located at a clutch side of the adjustable mounting system. In another embodiment, the short adjustment mechanism is located at an idler side of the adjustable mounting system.

In an embodiment, the mounting system incorporates a tension bar with a length that is adjustable over a significant length, sometimes herein referred to as a long adjustment mechanism. In an embodiment, the long adjustment mechanism includes a female tension bar and a male tension bar adjustably mounted within the female tension bar. In an embodiment, the long adjustment mechanism includes a mechanism for displacing the male tension bar relative to the female tension bar, and a mechanism for locking the male tension bar within the female tension bar.

In an embodiment of long adjustment mechanism, the female tension bar includes slots at a plurality of stop positions spaced along the female tension bar, and the male tension bar includes a compressible member that may expand within slots at one or more of the stop positions. In another embodiment, a male tension bar includes a pull rod mounted for displacement within the male tension bar, and a conical expander mechanism that expands to wedge against an inner wall of a female tension bar. In a further embodiment, a female tension bar includes a plurality of ridges defining detent positions spaced along an inner wall of the female tension bar. The male tension bar is a profiled push bar that supports ball bearings that engage the female tension bar in the detent positions, and that includes locked and unlocked configurations.

In an embodiment, the mounting system includes an end member such as an end pad for frictionally engaging the window frame, and for dampening the force of the mounting system against the window frame.

In various embodiments, a mounting system for a roller blind incorporates an adjustable length tension bar based upon any of the long adjustment mechanisms, in combination with any of the short adjustment mechanisms. In other embodiments, a mounting system for a roller blind incorporates a fixed length tension bar, in combination with any of the short adjustment mechanisms.

The disclosure further provides various embodiments of roller blinds incorporating the mounting systems described herein.

Figure 21:
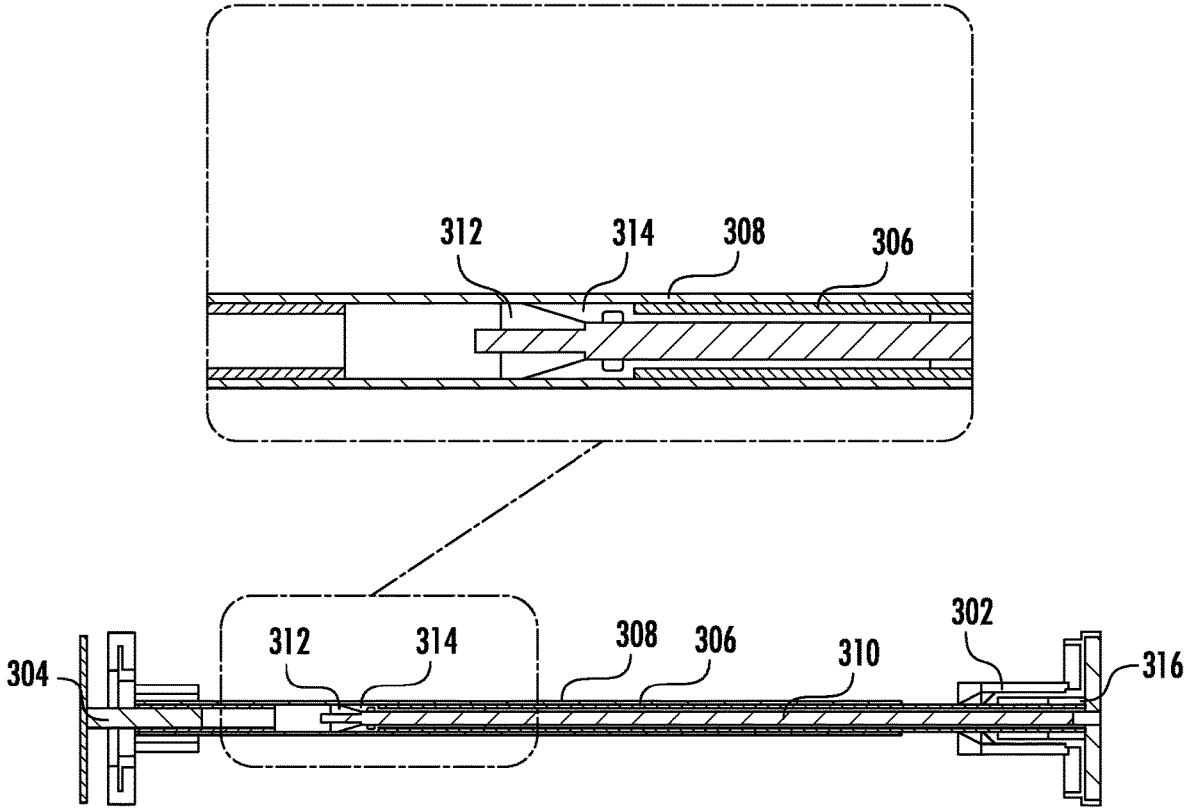
FIG. 21 is a side sectional view of an adjustable blinds assembly with long adjustment mechanism, according to an embodiment.

Various roller blinds adjustable mounting systems incorporating a long adjustment mechanism to adjust the length of a tension bar are described below with reference to the following embodiments:

(a) a lever assembly for long adjustment is illustrated at FIG. 1-6;

(b) a detent assembly with button for long adjustment is illustrated at FIGS. 12, 13A, 13B, 14, 19, and 20;

(c) a cone-expander for long adjustment is illustrated at FIG. 21.

Figure 22:
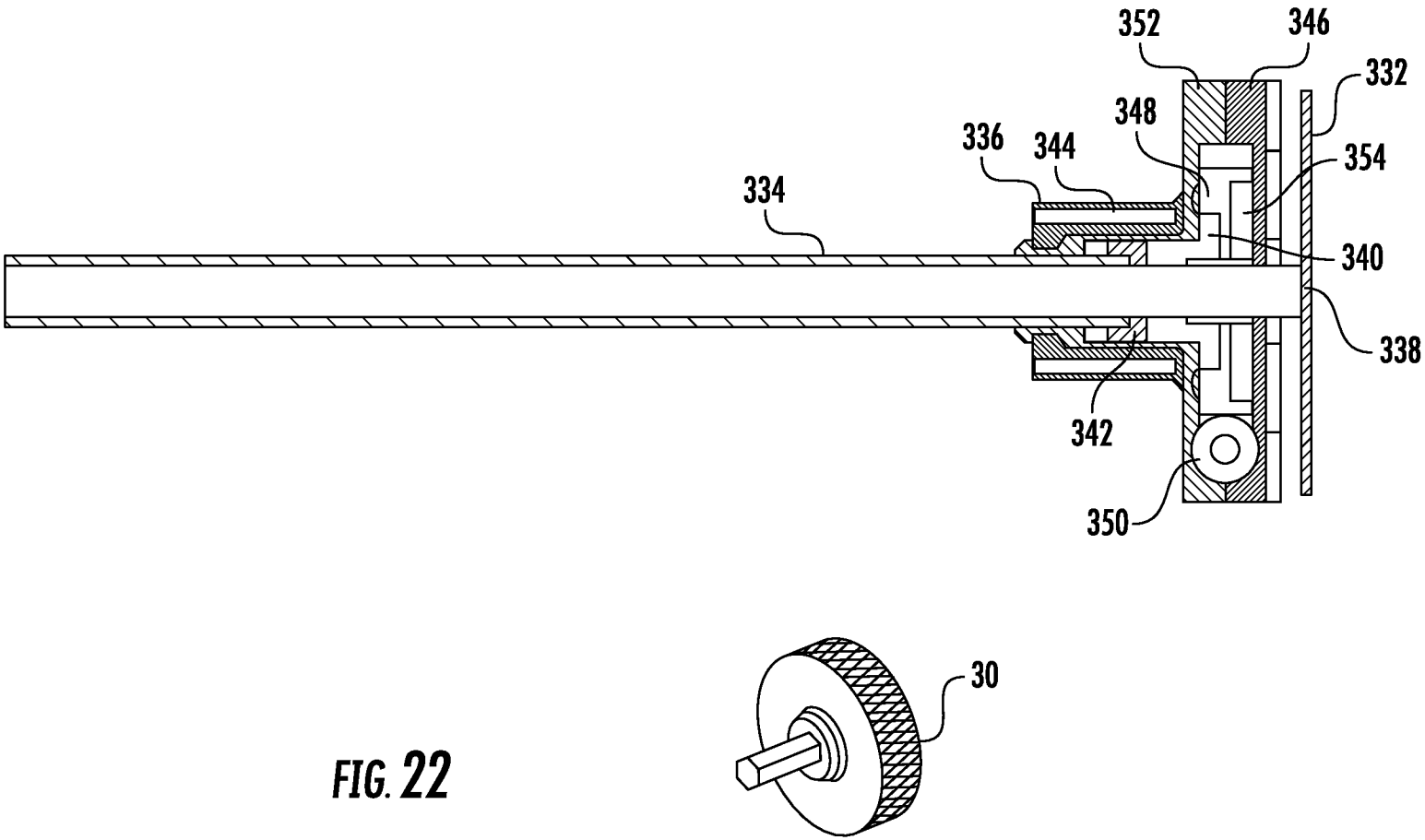
FIG. 22 is a side sectional view of the clutch side of an adjustable blinds assembly with short adjustment mechanism, according to an embodiment.

Various roller blinds adjustable mounting systems incorporating a short adjustment mechanism to adjust over a short distance the width between end members coupled to a tension bar, are described below with reference to the following embodiments:

(a) a spring-loaded button assembly for short adjustment is illustrated at FIGS. 8-11;

(b) a spur gear assembly with dial for short adjustment is illustrated at FIGS. 15-18;

(c) a worm gear assembly for short adjustment is illustrated at FIG. 22.

Figure 7:
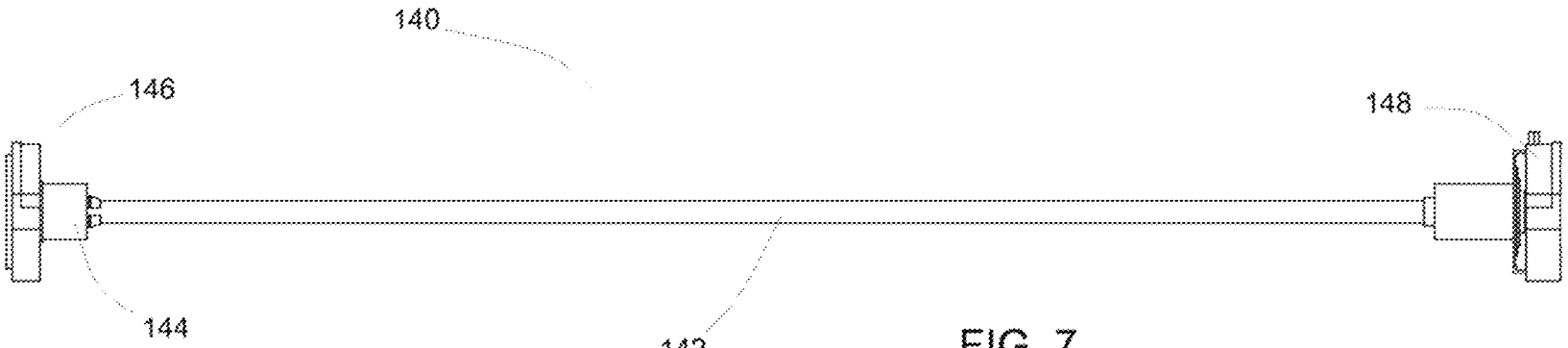
FIG. 7 is an side perspective view of a fixed width tension bar assembly, according to an embodiment.
Figure 8:
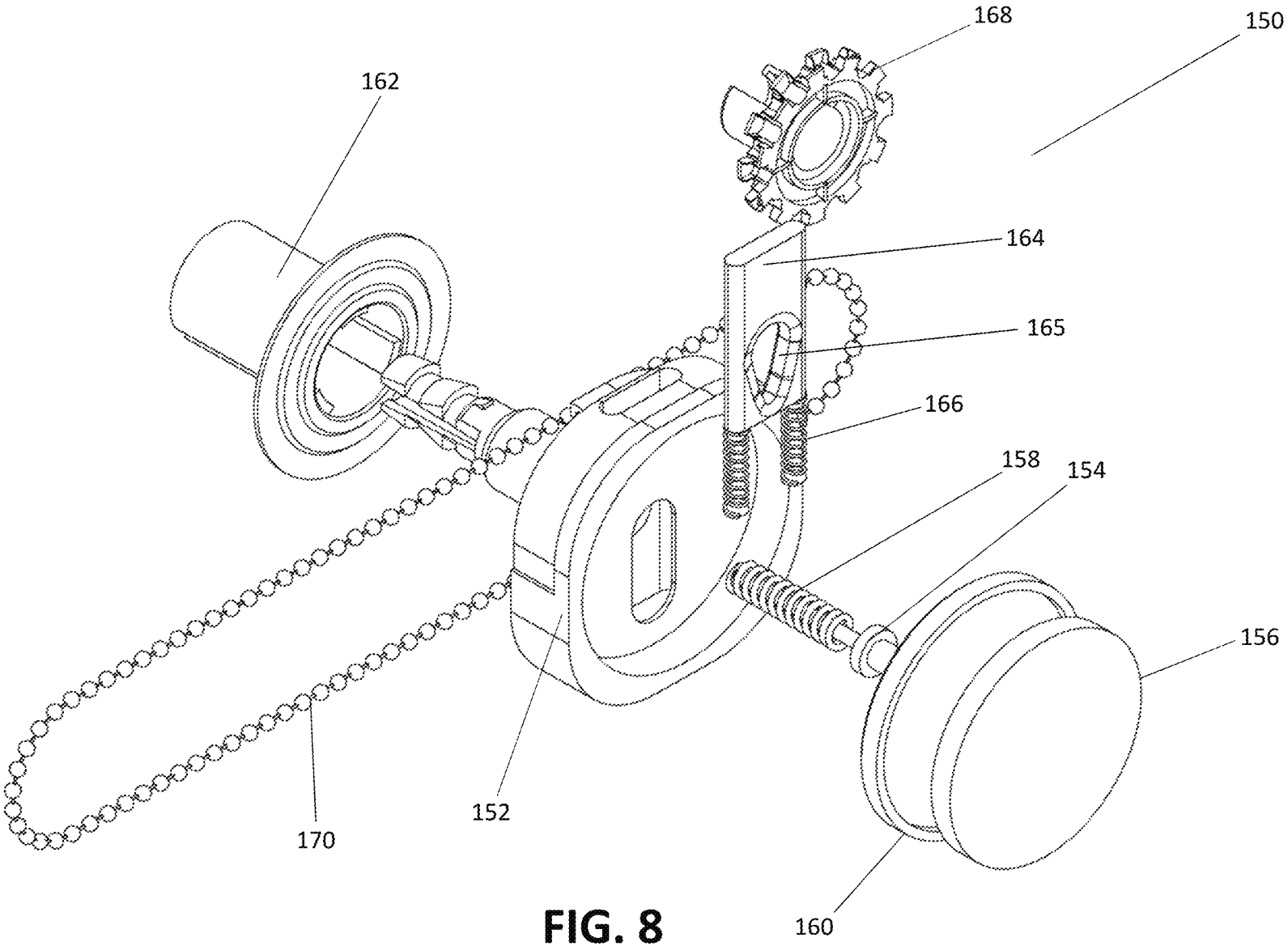
FIG. 8 is an exploded view of a clutch assembly for an adjustable blinds assembly, according to an embodiment
Figure 10:
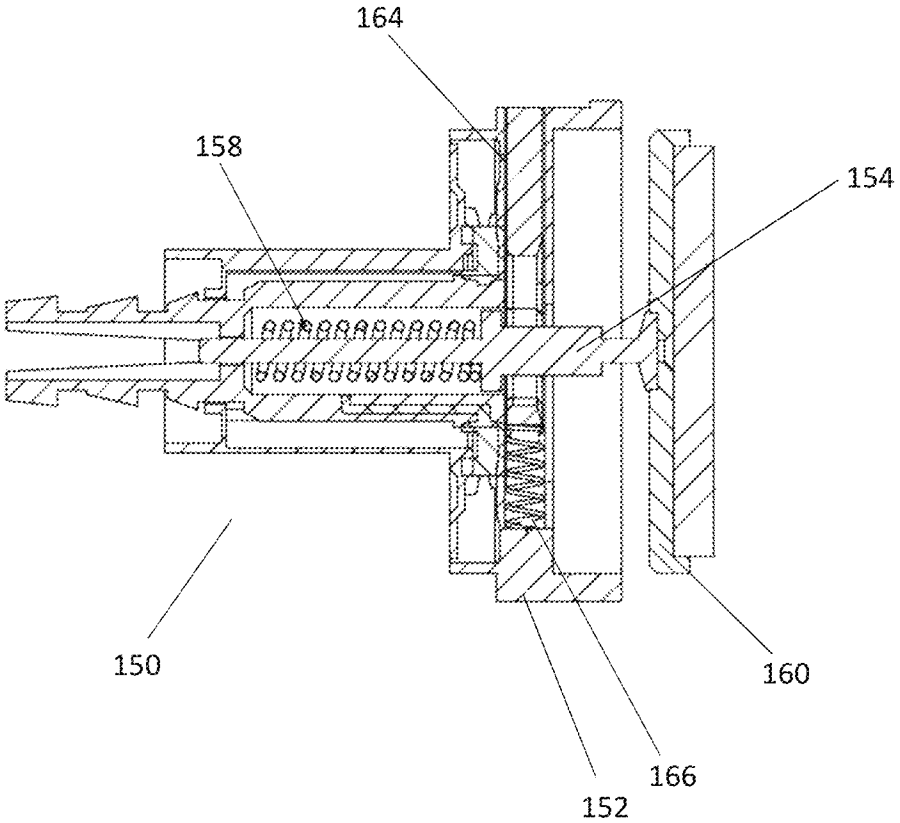
FIG. 10 is a side sectional view of a clutch assembly for an adjustable blinds assembly, according to the embodiment of FIG. 8.

In other embodiments, a roller blinds adjustable mounting system incorporates a fixed length tension bar, as illustrated in FIG. 7, wherein the fixed length tension bar may be deployed in combination with any of the short adjustment mechanisms.

The roller blinds mounting systems described below include examples of a particular long adjustment mechanism in combination with a particular short adjustment mechanism. The lever assembly for long adjustment of FIG. 1-6 is described as usable in combination with the spring-loaded button assembly for short adjustment of FIGS. 8-11. The detent assembly with button for long adjustment of FIGS. 12, 13A, 13B, 14, 19, and 20 is described as usable in combination with the a spur gear assembly with dial for short adjustment is illustrated at FIGS. 15-18. However it should be noted, advantageously, that various long adjustment mechanisms are interchangeable, and various short adjustment mechanisms are interchangeable. For example, the cone-expander long adjustment mechanism of FIG. 21 may be easily interchanged with the lever assembly long adjustment mechanism of FIGS. 1-6. In another example, the spur gear assembly with dial for short adjustment of FIGS. 15-18 may be easily interchanged with the worm gear assembly for short adjustment of FIG. 22.

Various long adjustment mechanisms disclosed herein incorporate external actuating implements; similarly various short adjustment mechanisms incorporate external actuating implements. In the present disclosure, an external actuating implement refers to an external component of the adjustable window blinds or shades that can be manipulated or otherwise operated by a user to actuate a long adjustment mechanism, or to actuate a short adjustment mechanism. Examples of external actuating implements for long adjustment mechanisms are the unlock handle 108 of lever assembly 115 (FIG. 2), and the detent push button 220 of detent assembly 200. Examples of external actuating implements for short adjustment mechanisms are the button 167 of locking pin 164 in the spring-loaded button assembly 150 (FIGS. 9, 11), and the adjustment dial 238 of spur gear assembly with dial 225. In various embodiments, the external actuating mechanism may be manipulated by a user without requiring tools. In an alternative embodiment, such as the worm gear 350 of the worm gear assembly for short adjustment of FIG. 22, an external actuating mechanism be manipulated by a user using a tool 360.

FIGS. 1-6 show an adjustable-length tension bar assembly of an adjustable and portable blind assembly 100, which permits easy installation on various window frame sizes without any tooling. Adjustable length blind assembly 100 incorporates an internal adjustable tension bar to accommodate a range of window sizes. FIG. 1 is a perspective view of disassembled components of an adjustable blind assembly, including a male tension bar 116 and a female tension bar 118. In the fully assembled adjustable blinds assembly 100, the male tension bar 116 and a female tension bar 118 are secured together at a selected length, and extend through male fabric tube 110 and female fabric tube 112. A clicker 122 is located at the male tension bar 116. Components at a clutch end of the adjustable length blind assembly include a clutch assembly 150 engaged by a chain or continuous cord loop 128. The other, idler, end of the blind assembly includes an idler 104, retaining ring 120, and an unlock handle 108. At both ends of adjustable length blind assembly 100, end plates 102 and rubber end pads 106 serve as mounting structures for mounting assembly 100 to a window frame under pressure. Other components include a male fabric tube 110 and female fabric tube 112 coupled in an adjustable length telescoping structure. In an embodiment, male fabric tube 110 and female fabric tube 112 respectively support first and second blinds fabrics (not shown). Male blind housing 124 and female blind housing 126 provide an adjustable-length housing for blind assembly 100, and support other components of adjustable blinds assembly 100 during installation.

Figure 2:
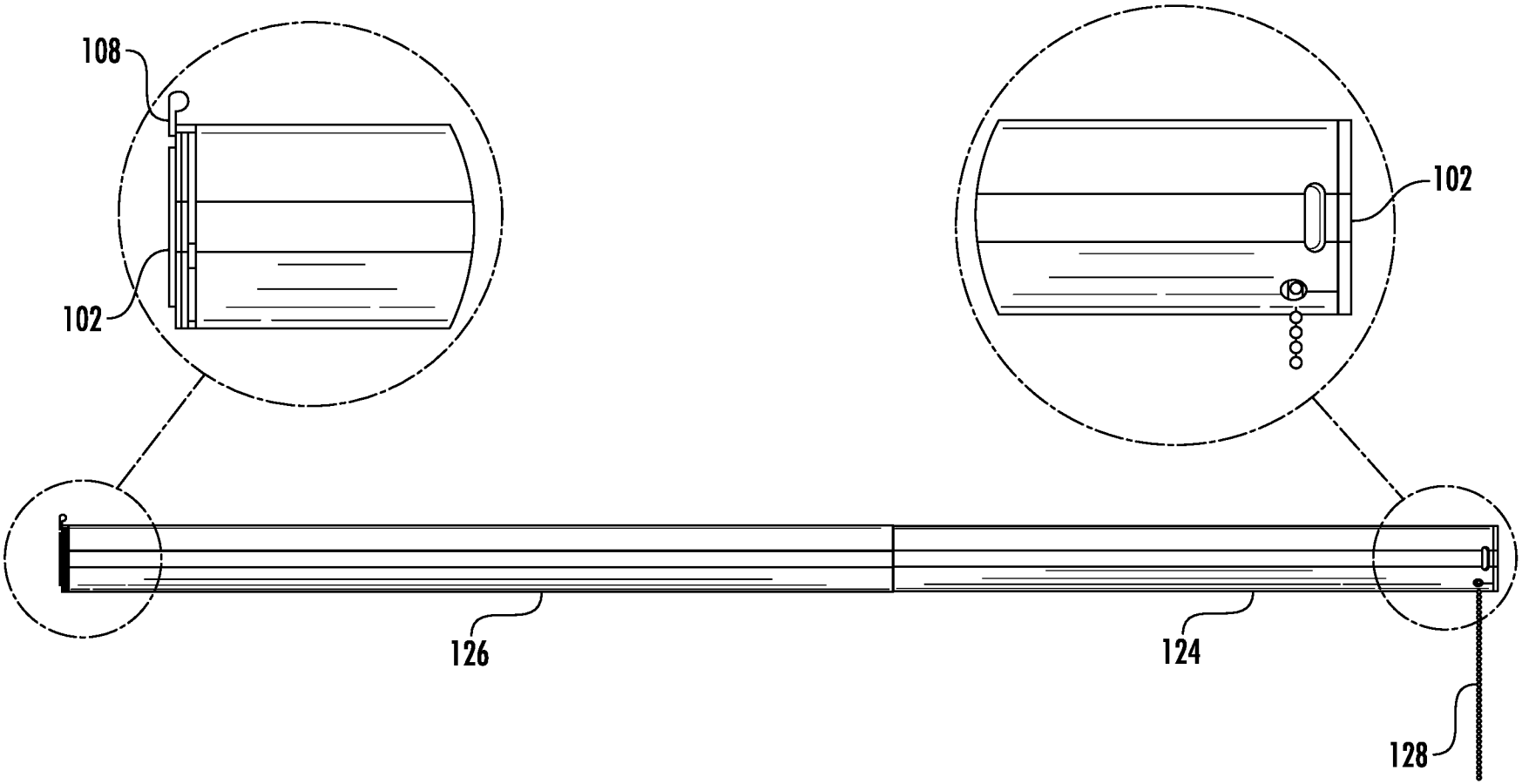
FIG. 2 is a front side exterior perspective view of an adjustable blinds assembly, according to the embodiment of FIG. 1.
Figure 3:
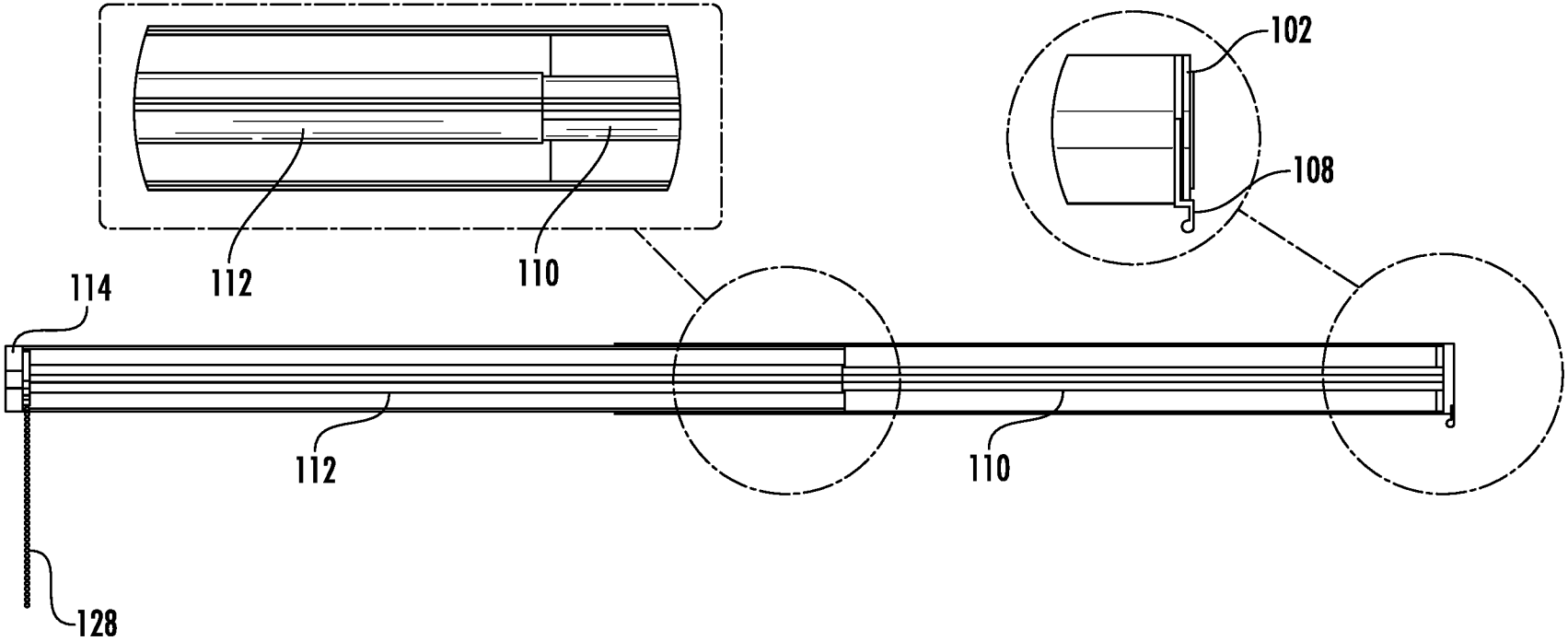
FIG. 3 is a back side perspective view of an adjustable blinds assembly with blinds housing removed, according to the embodiment of FIG. 1.

FIG. 2 is a front side exterior perspective view of the adjustable blinds assembly 100, including adjustably coupled female blinds housing 126 and male blinds housing 124. The detail view of the end of female blinds housing 126 includes unlock handle 108 and left end plate 101. Unlock handle is shown in a raised, locked position. The detail view of the end of male blinds housing 124 includes chain 128 and right end plate 102. FIG. 3 is a back side perspective view of the adjustable blinds assembly 100 with blinds housing removed. The center detail shows the adjustable length telescoping structure of male fabric tube 110 and female fabric tube 112. At the end of the male fabric tube, the unlock handle 108 is shown in a lowered, unlocked position.

Figure 4:
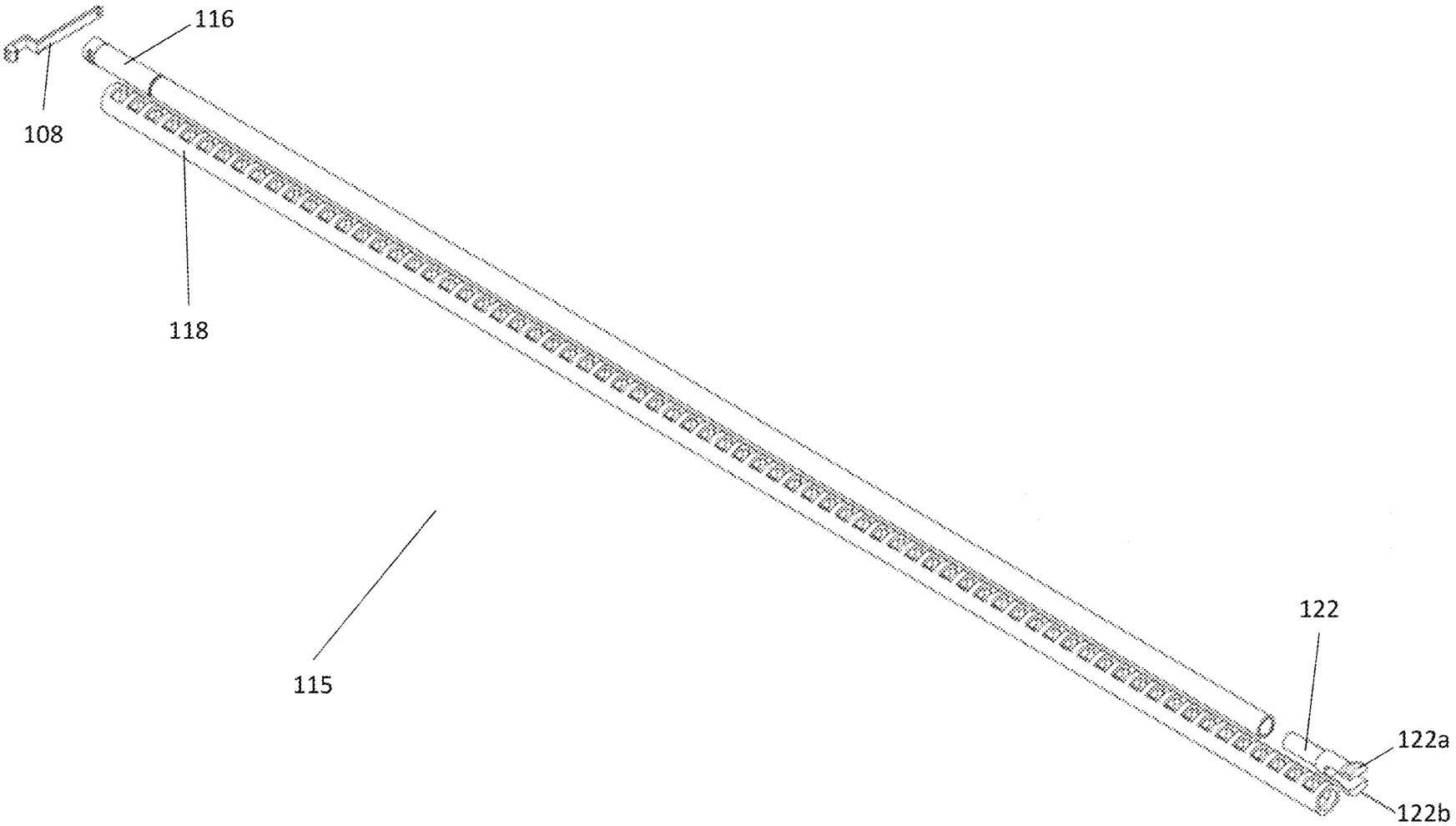
FIG. 4 is a perspective view of a tension bar assembly for an adjustable blinds assembly, according to the embodiment of FIG. 1.
Figure 5:
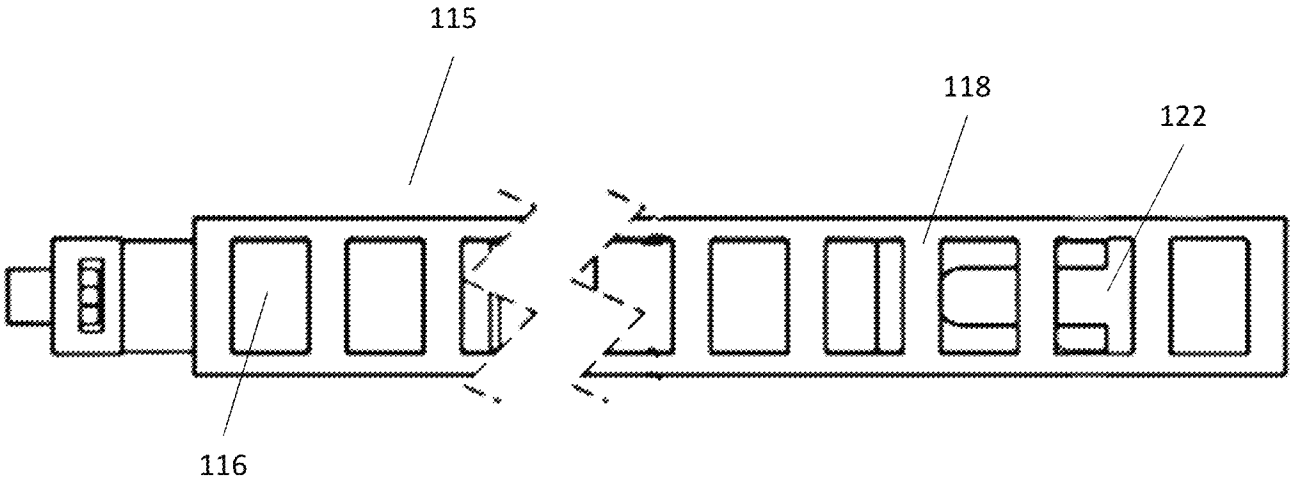
FIG. 5 is a partial, somewhat schematic side view of a tension bar assembly for an adjustable blinds assembly, in open configuration, according to the embodiment of FIG. 4.

FIG. 4 is a perspective view of an adjustable length tension bar assembly, or lever assembly, 115. Lever assembly 115 includes a male tension bar 116 and a slotted female tension bar 118. A clicker 122 with outwardly biased ears 122*a*, 122*b* is attached to one end of the male tension bar. A lever (unlock handle 108) is attached at the other end of the male tension bar, and controls the configuration of the adjustable length tension bar assembly 115. When fully assembled, the female tension bar 118 is fixed and the male tension bar 116 is mounted to slide, and rotate, within the female tension bar. As the unlock handle 108 is rotated, the clicker 122 rotates with the male tension bar 116. In one configuration, the ears 122*a*, 122*b* of clicker 122 compress against the inner wall of the female tension bar 118, permitting the male tension bar to slide within the female tension bar. In the other configuration, the ears 122*a*, 122*b* of clicker 122 decompress when released within one of the slots of female tension bar 118.

Figure 6:
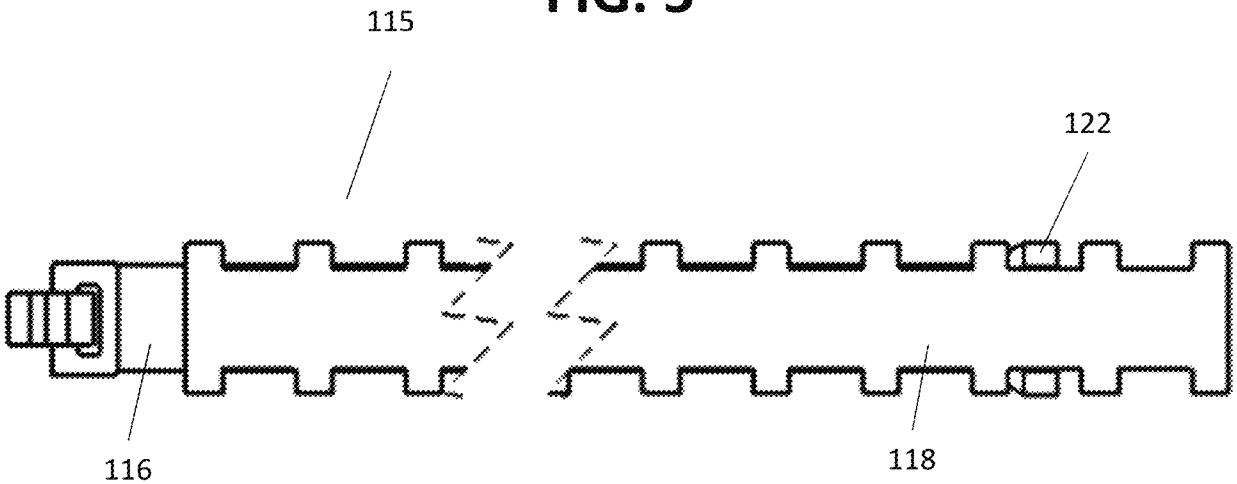
FIG. 6 is a partial, somewhat schematic side view of a tension bar assembly for an adjustable blinds assembly, in locked configuration, according to the embodiment of FIG. 4.

Internal adjustable tension bar assembly 115 has two configurations, open and locked, depending on the position of unlock handle 108 (cf. FIGS. 2, 3). The tension bar assembly 115 is open when the clicker 122 is compressed. This configuration allows the male tension bar 116 and the female tension bar to slide freely, extending or contracting the length of the adjustable blinds. This open configuration is shown schematically in FIG. 5. In contrast, when the unlock handle is rotated to the locked position (e.g., 90 degrees), the clicker 122 decompresses at one of the sets of slots of female tension bar 118. In one embodiment, when in this locked configuration, the tension bar can be extended but cannot be contracted. This locked configuration is shown in FIG. 6.

FIG. 7 illustrates a fixed-length tension bar assembly 140. Fixed length tension bar assembly 140 includes a fixed length tension bar 142, such as an extruded bar. A clutch assembly 148 is located at a clutch end of the tension bar. The clutch assembly 148 includes a central recess (not shown) and the fixed length tension bar extends through the central recess. An idler 144 and idler end plate 146 is located at the other end of fixed length tension bar 142. In an embodiment, fixed length blinds incorporating fixed-length tension bar assemblies may be provided in various fixed sizes, which may be selected to fit specific window frame standards. As compared with the adjustable length tension bar assembly of FIGS. 1-6, the fixed-length tension bar assembly 140 of FIG. 7 does not require a telescoping housing or other window blinds structures such as adjustable width bottom bars (at the bottom of the blinds fabric); two sets of fabric; or internal adjustable tension rods with control mechanism. Hence, fixed length tension bar assemblies are amenable to lower cost manufacture. A fixed length tension bar assembly may include a short adjustment mechanism to facilitate mounting to a windows frame or casement. For example, the clutch assembly 148 may be based upon the short adjustment clutch assembly 150 of FIGS. 8-11.

FIGS. 8-11 show a clutch assembly, also herein called spring-loaded button assembly, for an adjustable blind assembly, incorporating a clutch assembly with a spring-loaded mechanism for short adjustment of mounting to a window frame. As seen in the exploded view of FIG. 8, the clutch assembly 150 serves two functions. Clutch assembly 150, including clutch 168 and clutch rotor 162, allows the fabric tubes of the blinds (not shown) to rotate freely while pulling on chain 170, while preventing rotation of the fabric tubes in other circumstances, as is conventional. Secondly, the clutch assembly incorporates a spring loaded short adjustment mechanism, which applies a continuous load to the window frame following a push of a button. Clutch assembly 150, including clutch 168 and clutch rotor 162, include a central recess, and a tension bar (not shown) extends through the central recess and is coupled to clutch and spring release body 152 as subassemblies of an adjustable-width mounting assembly for a roller blind. Roller blind clutches of this type are supplied, for example, by Ciera Industries, Inc. of Valencia Calif.

Figure 9:
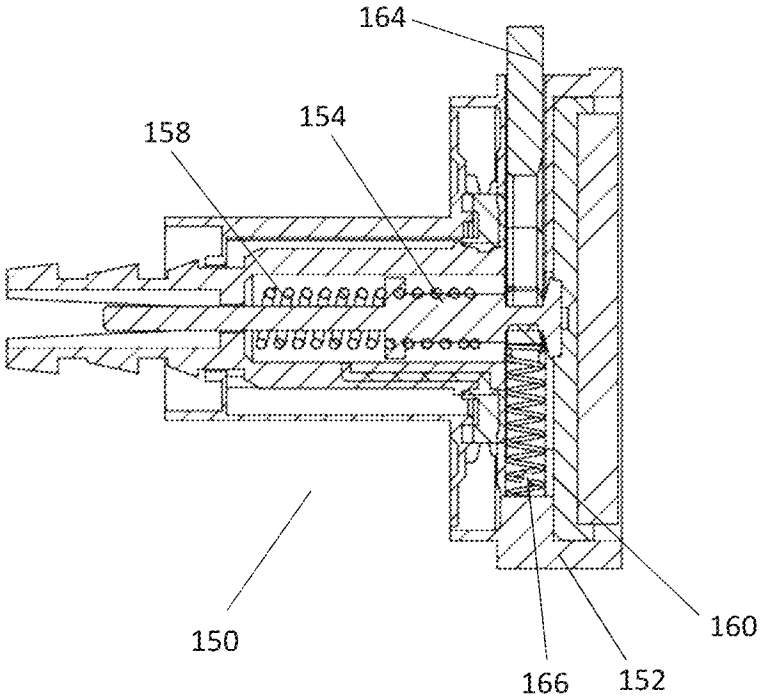
FIG. 9 is a side sectional view of a clutch assembly for an adjustable blinds assembly, according to the embodiment of FIG. 8.

Key components in the spring loaded mechanism include a clutch and spring release body 152, compression spring 158, locking pin 164, launch pin 154, and locking pin compression spring 166. The clutch assembly 150 has two modes of operation: closed and extended. To close the spring loaded assembly, as shown in FIG. 9, the end plate 160 and the launch pin 154 are pushed into the clutch and spring release body 152. Enough force must be applied to overcome the compression spring 158. When the end plate 160 and the launch pin 154 are pushed into the clutch and spring release body 152, the locking pin 164 is free to push upwards under the force of locking pin compression springs 166. A profiled aperture 165 of the locking pin 164 engages the launch pin 154, locking the clutch assembly 150 in closed configuration.

Figure 11:
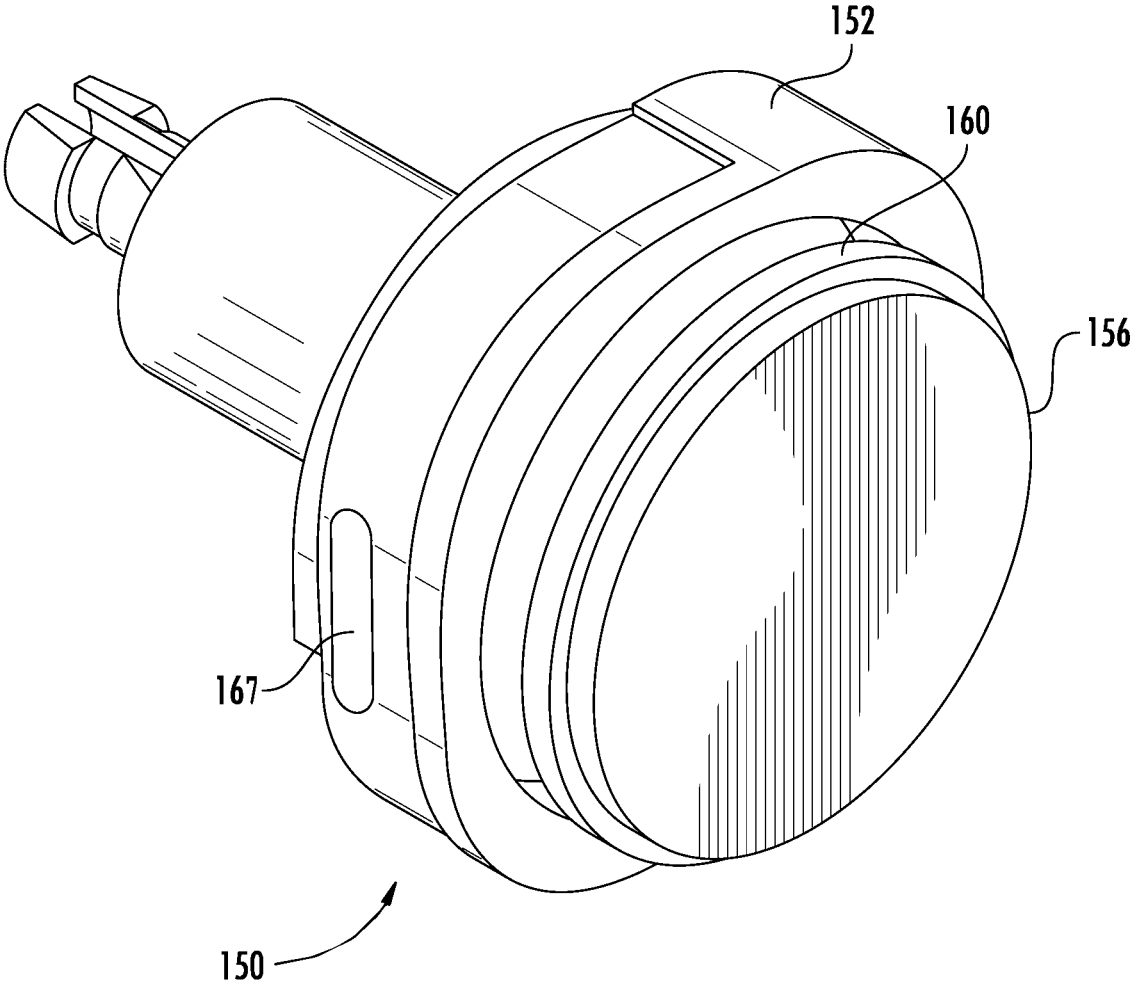
FIG. 11 is a perspective view of a clutch assembly for an adjustable blinds assembly, according to the embodiment of FIG. 8.

The locking pin 164 terminates at a button 167 (FIG. 11). To extend the clutch assembly 150, the user presses the locking pin 164 into the clutch and spring release body 152 via button 165. The movement of locking pin 164 disengages the launch pin 154, allowing the compression spring 158 to decompress. The potential energy stored in compression spring 158 is released, forcing the launch pin 154 and the end plate 160 out of the clutch and spring release body 152. In this locked configuration, the adjustable blind assembly is fully extended to the width of a window frame.

In an embodiment, while in the locked configuration the clutch assembly 150 applies sufficient force to the window frame to hold up the entire adjustable blind assembly. In an embodiment, the clutch assembly 150 applies approximately 40 pounds of force to the window frame when in the locked configuration through metal end cap 160 and rubber end pad 156 (FIG. 11). Rubber end pad 156 provides friction and absorbs excess pressure when engaging a window frame or casement.

The adjustable blind assembly of FIGS. 8-11 uses a tension bar as a load-bearing bar in conjunction with to load applied to a window frame by the clutch assembly 150. The tension bar assembly coupled to the clutch assembly 150 may have a fix width, such as the tension bar assembly 140 of FIG. 7. Alternatively the tension bar assembly coupled to assembly 150 may allow a long adjustment of width, such as the adjustable tension bar 115 of FIGS. 1-6.

In an example, a user installed an adjustable length blind assembly 100 incorporating the long-adjustable tension bar 115 of FIGS. 1-6 and the short-adjustable clutch assembly 150 of FIGS. 8-11. The user compressed the clutch assembly 150 so that it was in its closed position, pushing the end plate 160 against the clutch body 152. The user placed the unlock handle 108 in its locked position, then extended the housing of adjustable length blind assembly 100 to a length approximately corresponding to the width of the windows frame targeted for installation. The user then positioned the adjustable length blind assembly 100 within the windows casement at the intended mounting location, and pushed the release button to extend the clutch assembly.

To uninstall the adjustable length blind assembly 100, a user pulled the unlock handle 108 to its open position, disengaging internal tension bar 115 (FIG. 3). Two persons may support the adjustable length blind assembly 100 to prevent it from falling, before disengaging the internal tension bar 115.

Figure 12:
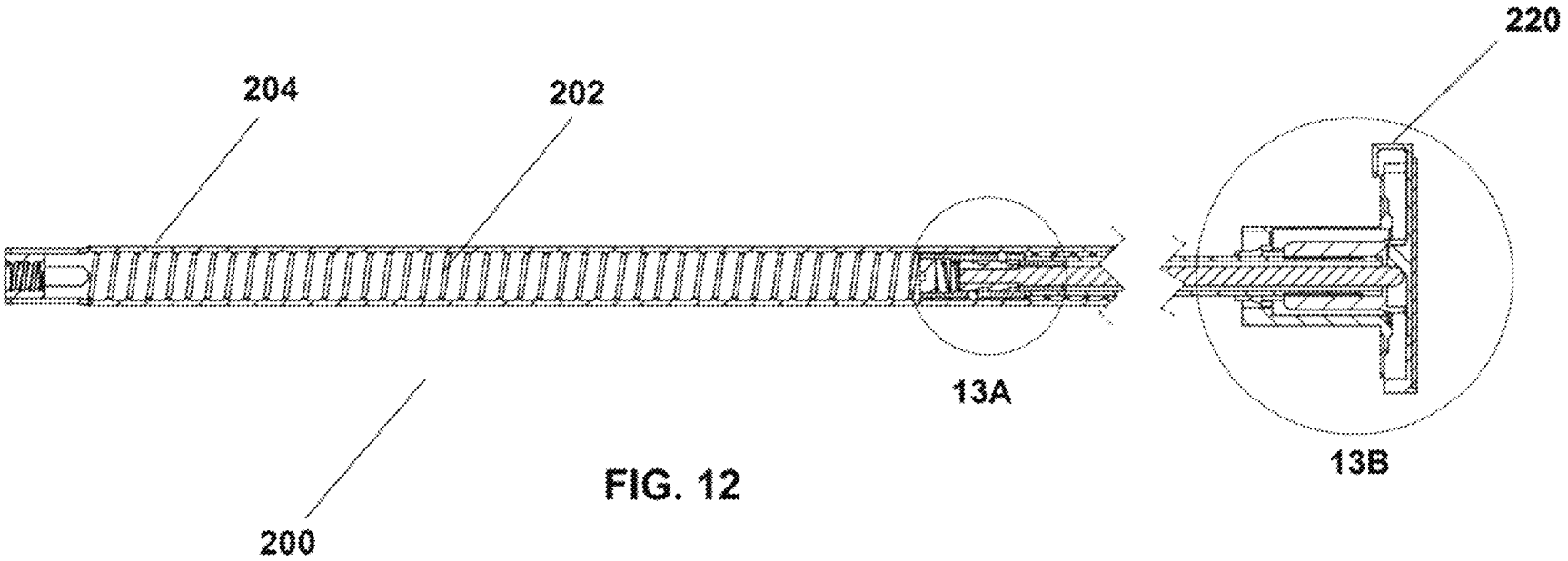
FIG. 12 is a side sectional view of a detent assembly for an adjustable blinds assembly, according to an embodiment.

FIG. 12 is a side sectional view of a detent assembly 200, which provides an alternative mechanism for long length adjustment of a tension bar, via a detent mechanism. Detent assembly 200 includes a corrugated tube 204 housing a detent 202. A detent push button 220 controls operation of the detent mechanism.

Figure 13A:
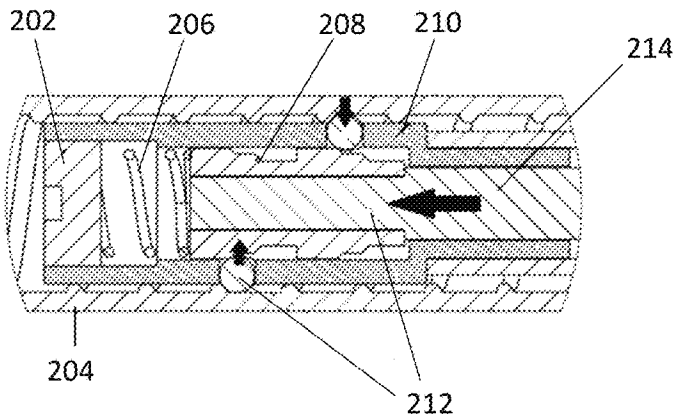
FIG. 13A is a side sectional view of a first detail of a detent assembly for an adjustable blinds assembly, from the detail 13A of FIG. 12.
Figure 13B:
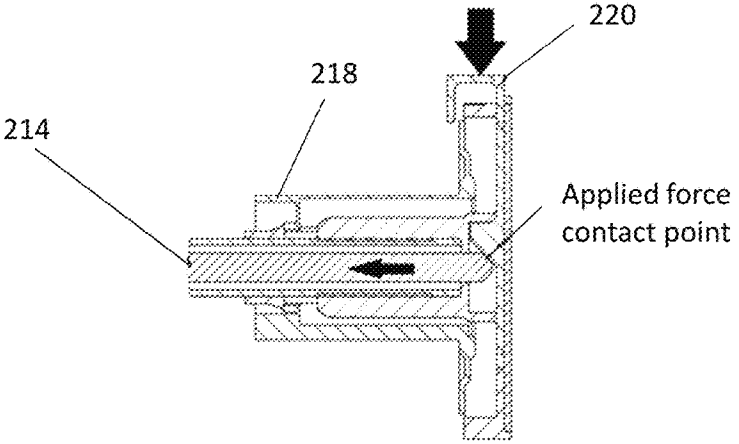
FIG. 13B is a side sectional view of a second detail of a detent assembly for an adjustable blinds assembly, from the detail 13B of FIG. 12.

FIGS. 13A and 13B are side sectional views corresponding to details 13A, 13B respectively of the detent assembly 200 of FIG. 12. In order to engage the long adjustment detent assembly 200, the user pushes down the detent button 220 to apply a tangential force to the push rod 214 within clutch rotor 218, at the applied force contact point. The movement of push rod 214 in turn moves the profiled head 208 to the left. Traversal of the profile head 208 to the left allows the ball bearings 212 to move towards the interior of the head casing 210. The inward displacement of ball bearings 212 provides clearance between corrugations at interior profile of the corrugated tube 204, and the ball bearings. In this configuration, since the ball bearings 212 are no longer held in place within corrugated tube 204, the detent 202 of detent assembly 200 is free to move as indicated by the arrow, compressing the compression spring 206.

Figure 14:
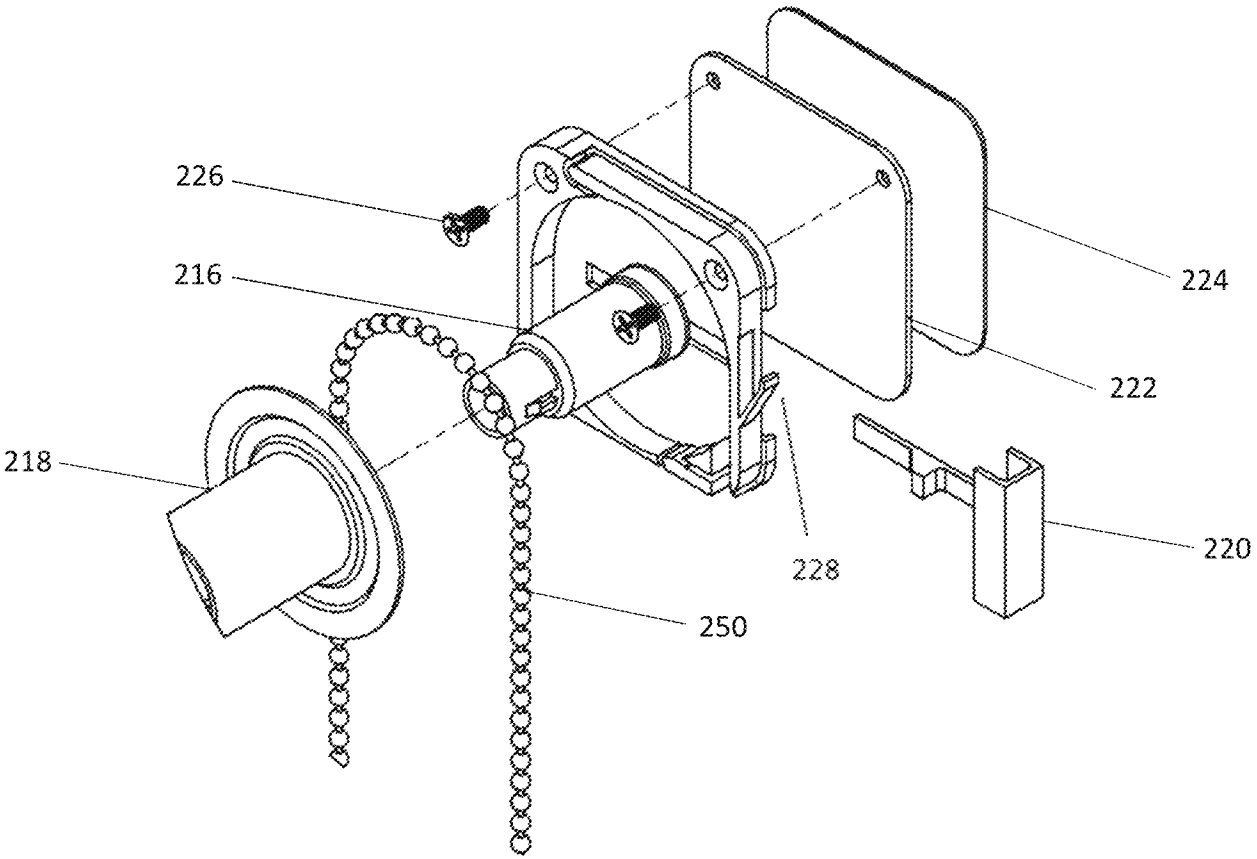
FIG. 14 is an exploded view of components at the clutch end of a detent assembly for an adjustable blinds assembly, according to the embodiment of FIG. 12.

FIG. 14 is an exploded view of components at the clutch end of the long adjustment detent assembly 200 of FIG. 12, showing a mechanism for disengagement of long adjustment. When a user presses and releases the detent push button 220, a plastic fin 228 held in compression retracts the push button 220. The fin 228 is located on the ABS plastic casing 216. As an alternative to the plastic fin 228, the long adjustment detent assembly could incorporate a spring to retract the push button 220. Once the push button is retracted, the force applied onto the push rod 214 is removed. The release of compression spring 206 returns the detent assembly 200 into its locked configuration in which the ball bearings 212 are held in place within corrugated tube 204.

Figure 15:
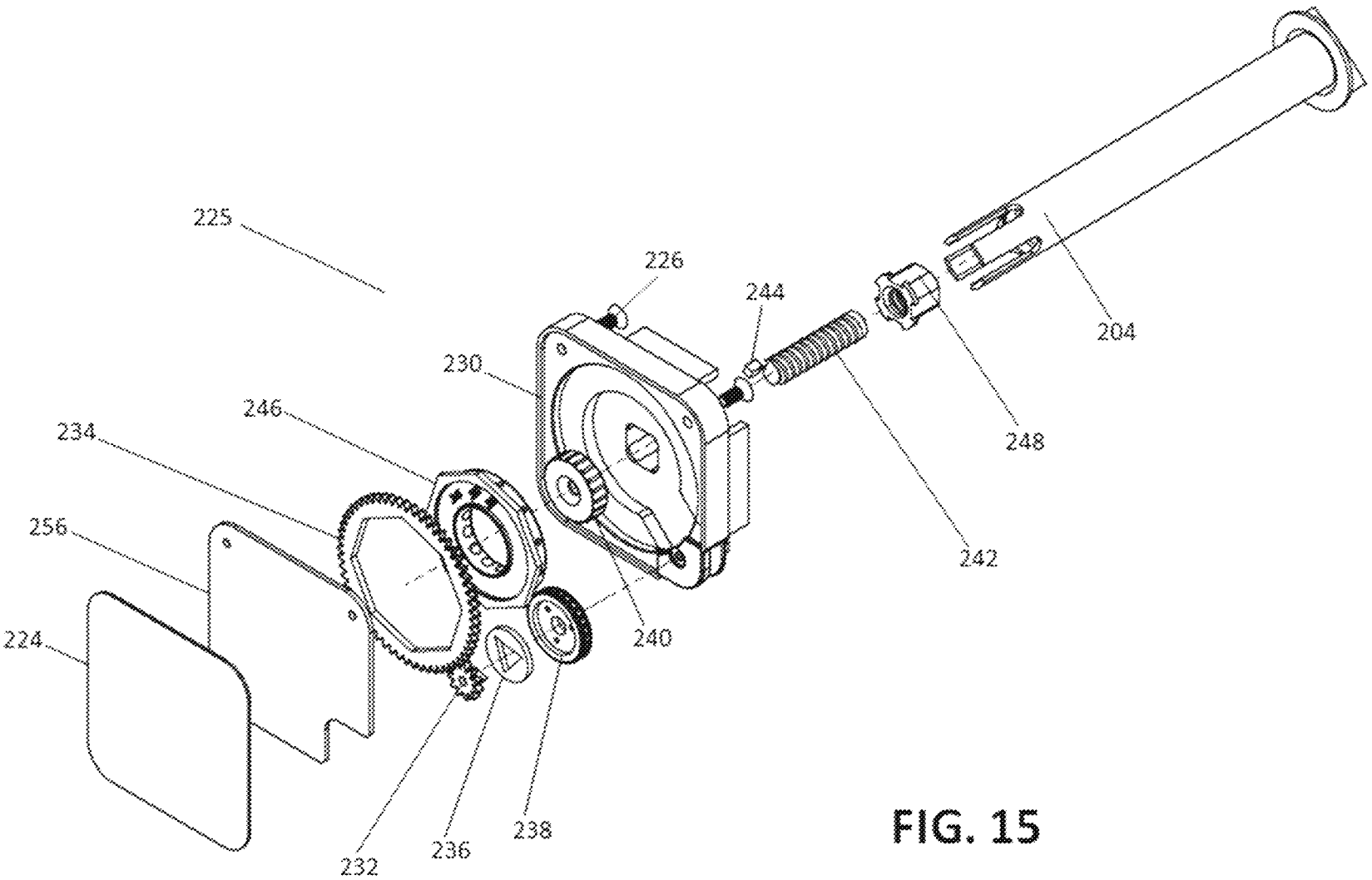
FIG. 15 is an exploded view of components at the clutch end of an adjustable blinds assembly, according to an embodiment.

FIG. 15 is an exploded view of components at the clutch end of an adjustable blinds assembly that provides short adjustment of the width between the first and second end plates, using a dial-actuated adjustment mechanism, spur gear assembly with dial 225. Components of the adjustable blind assembly seen in FIG. 14 include corrugated tube 204 joined to a threaded nut 248. Threaded pin or screw 242 is mounted within threaded nut 248, and is keyed to a bronze radial slip clutch 240 by a square key 244.

A casing 230, together with end cap 256, acts as a housing for components of the short adjustment assembly. These components includes a slip clutch 240 and plunger adapter 246, i.e., radial clutch gear. Other components include spur gear system 232, 234, and an adjustment dial 238 that is coupled to spur gear 232 by pinion adaptor 236. End cap 256 covers working components of the short adjustment assembly, and is secured to casing 230 via screws 226. A resilient end pad 224 secured to metal end cap 256 provides friction and dampens the force of the short adjustment mechanism against the window frame. In an embodiment, the end cap 256 is formed of a metal, the casing 230 is formed of an engineering plastic, and the end pad 224 is formed of rubber, it being understood these materials are merely exemplary.

Figure 17:
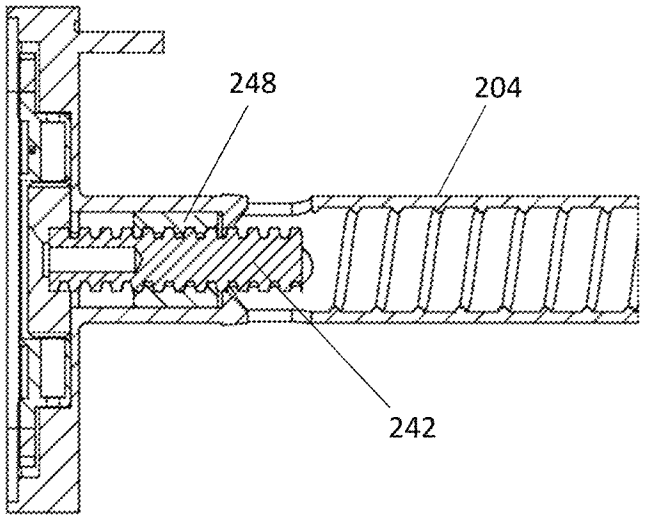
FIG. 17 is a side sectional view of a dial adjustment assembly for short adjustment of an adjustable blinds assembly, according to the embodiment of FIG. 15.
Figure 16:
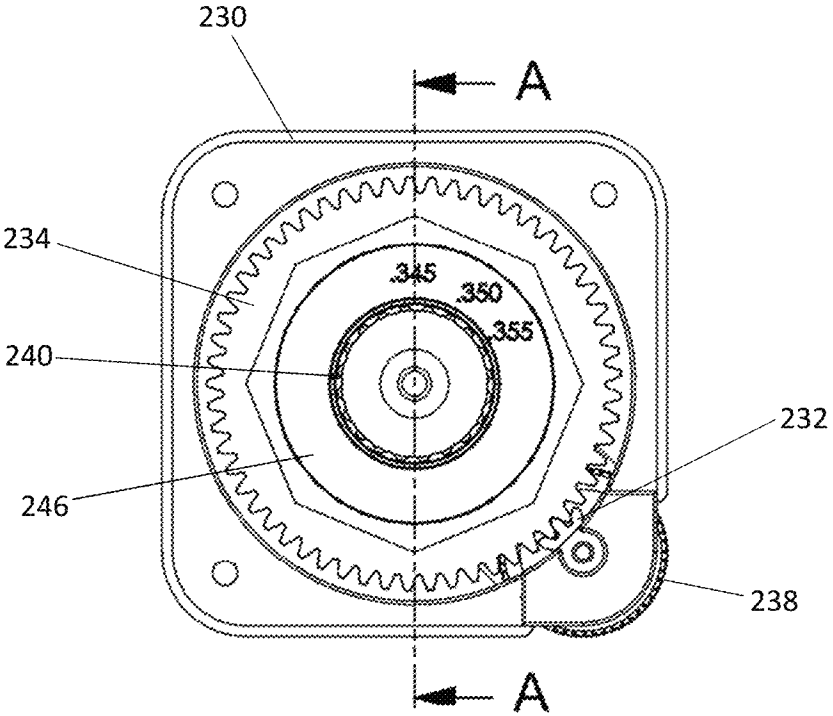
FIG. 16 is an interior end view of a dial adjustment assembly for short adjustment of an adjustable blinds assembly, according to the embodiment of FIG. 15.

The dial adjustment system of FIGS. 16 and 17 provides small, continuous length adjustments (e.g., ±0.25 in) of the adjustable blinds assembly of FIG. 15. FIG. 16 is an interior view of a dial adjustment assembly for short adjustment of the adjustable blinds assembly, and FIG. 17 is a side sectional view of the short adjustment end. The mechanism uses a spur gear system 232, 234 to transfer torque from the adjustment dial 238 to the ACME screw 242. Rotation of the screw 242 within the ACME threaded nut 248 provides linear displacement of the corrugated tube 204. The torque transferred from an adjustment dial 238 to the ACME screw 242 is limited by a radial slip clutch 240. The dial adjustment system of FIGS. 16 and 17 permits short adjustment of the detent assembly 200 manually, without requiring tools.

Figure 18:
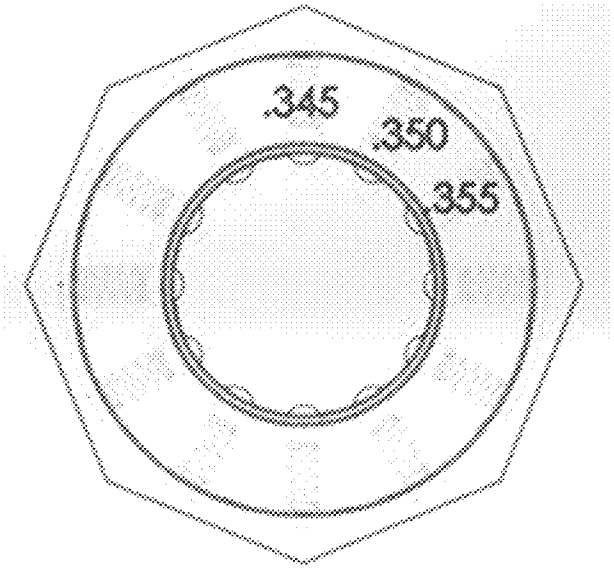
FIG. 18 is a detail schematic of a radial slip clutch system of a dial adjustment assembly for short adjustment of an adjustable blinds assembly, according to the embodiment of FIG. 16.

FIG. 18 provides a detail schematic of a radial slip clutch system for the dial adjustment assembly of FIG. 16. The radial clutch system is comprised of a bronze radial slip clutch 240, and a plunger adapter 246. The system utilizes ball plungers housed within the plunger adapter 246, to provide a gripping force onto the radial clutch 240. When a desired overload force is reached, the ball plunger compresses thereby allowing the bronze radial clutch to slip. This system is used to prevent any wall or window frame damage caused by high normal force loading.

In an embodiment, as a pivot compensation mechanism to compensate for wall misalignment and mounting error, an ABS plastic casing 230 at the short adjustment end has been designed with an allowance, e.g., ±2° allowance. This allowance may be achieved through use of flexible plastic prongs (not shown) attached to the corrugated tube 204, and through a minor differential slip between the bronze slip clutch 240 and the plunger adapter 246.

Figure 19:
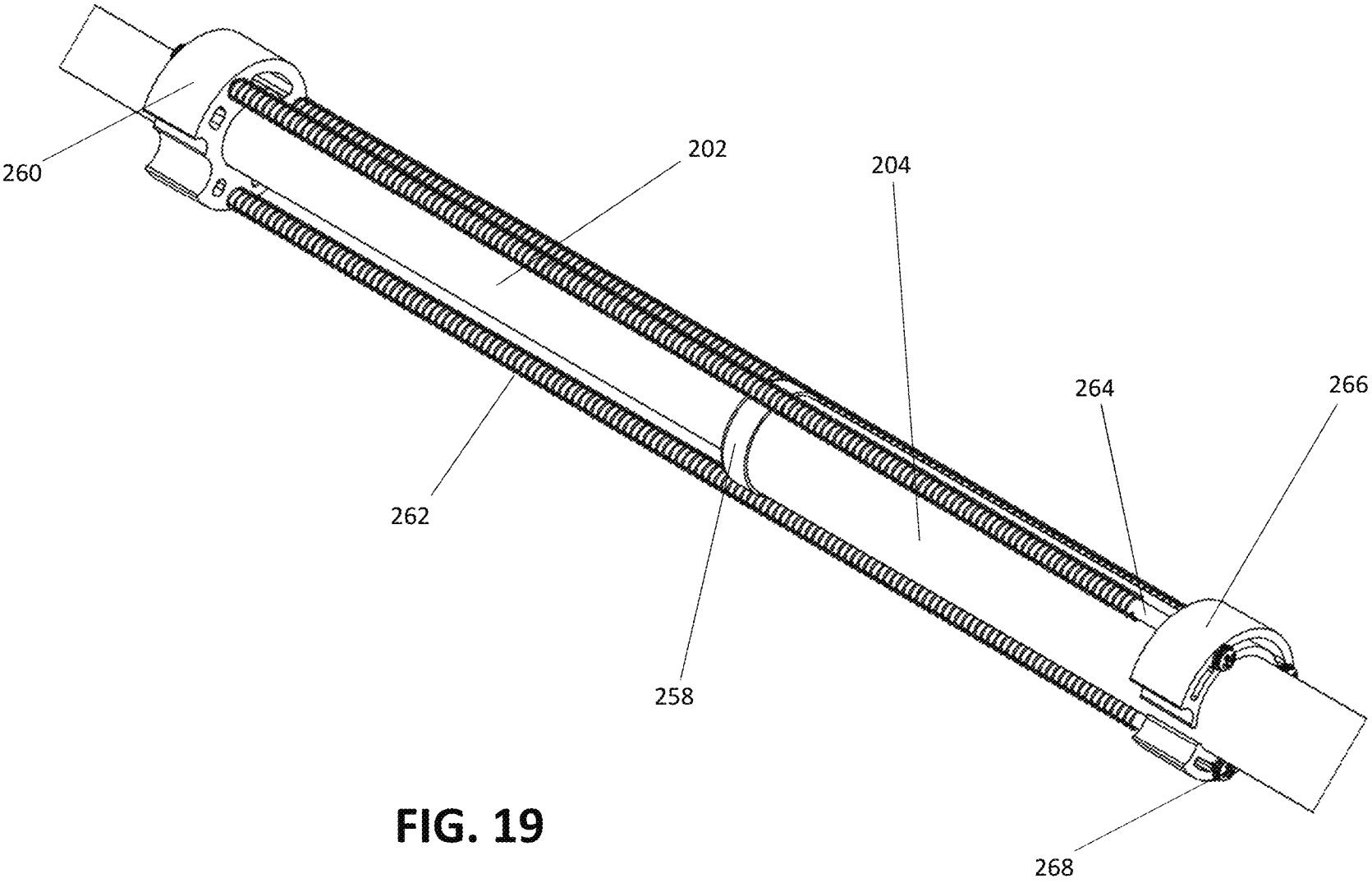
FIG. 19 is a perspective view of a bushing-spring assembly from an adjustable blinds assembly, according to an embodiment.
Figure 20:
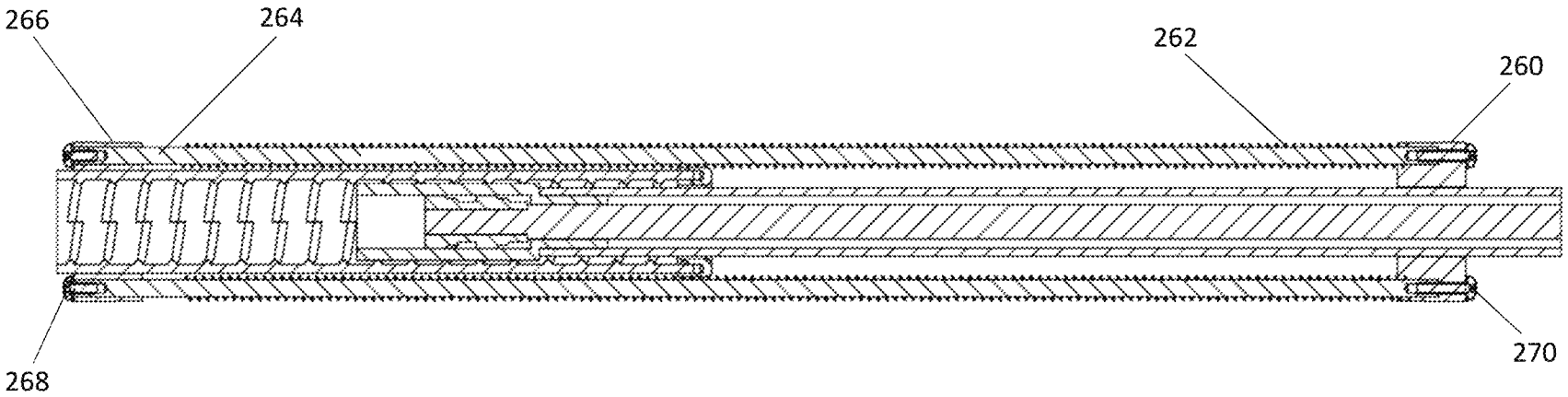
FIG. 20 is a side sectional view of a bushing-spring assembly from an adjustable blinds assembly, according to the embodiment of FIG. 19.

FIG. 19 is a perspective view, and FIG. 20 is a side sectional view, of a bushing-spring assembly from the adjustable blinds assembly with detent mechanism of FIGS. 15-18. To provide added bearing support to the assembly including detent 202, and corrugated tube 204 with corrugated tube end cap 258, a bushing-spring "splint" casing is utilized. The mechanism is made of two bushings 260, 266, including a corrugated tube bushing 266 placed around corrugated tube 204, and a detent bushing 260 around the detent assembly 202. These bushings are held together by three aluminum rods 264 with screws 268, 270 at either end. The detent bushing 260 is held fixed to the aluminum rods, but allowed to slide through the corrugated tube bushing 266. However, the travel is restricted by screws 268, and by compression springs 262 on the other side. This creates a support structure with slight play along the travel axis, dampening intermittent forces exerted on the assembly during operation.

FIG. 21 is a side sectional view of an adjustable blinds assembly 300 that provides long adjustment of the tension bar using a conical wedging mechanism. Adjustable blinds assembly 300 incorporates a cone 312 and an expander 314, which provide a frictional engagement mechanism for long adjustment of a tension bar that includes a female tension bar 308 and a male tension bar 306.

The adjustable blinds assembly 300 activates a mechanism (not shown) on the end of the male tension bar 306 adjacent a clutch end plate 316, to move the pull-rod 310 in and out of the male tension bar 306. For example, the pull-rod activation mechanism may be a threaded dial, a lever, a gear assembly, or a button. Inward motion of the pull-rod 310 pulls the cone 312 into the expander 314, creating a wedge. As best seen in the detail view of FIG. 21, this wedge increases the friction between the outer surface of the expander 314 and the internal wall of female tension bar 308. This friction will hold the male and female tension bar at a set distance, and allow the blinds assembly 300 to be tensioned without retracting. In an embodiment, this conical wedging mechanism applies a high level of friction between the female tension bar 308 and the expander 314. The friction between the cone 312 and expander 314 is relatively low, allowing the cone 312 to move freely within the mechanism.

An advantage of this wedge-based method of long adjustment is that the blinds can be expanded continuously to any length within the mechanism's range. That is, this long adjustment mechanism is not limited to discreet lengths, unlike the detent long adjustment mechanism of FIGS. 15-18, or the lever long adjustment mechanism of FIGS. 4-6.

FIG. 22 is a side sectional view of the clutch side of an adjustable blinds assembly with a short adjustment mechanism 330 including a worm set. A worm set 348, 350 is used to extend an end plate 332, in order to close off small gaps and to and apply pressure against a window casement (not shown). The worm set includes a worm 350, which can be rotated manually by a user using a tool 360 such as a torque knob, an Allen key, or a hex key. As the worm is rotated, the input torque is multiplied through the worm set 348, 350 by a gear ratio, for example of 7.5, allowing the user to apply large amount of force through the assembly with very little effort. As the worm gear 348 rotates, it turns a slip clutch 354 along with it which causes the threaded shaft 338 and end plate 332 to displace outwards, applying force against the window casement. The worm set is contained between a housing 346 adjacent end plate 332, and a clutch end 352.

As the blind is tensioned using this method, the load from the end plate 332 is transferred through the threaded shaft 338, through the slip clutch 354, through to a steel nut 342, then bronze bushing 344. These mechanisms are contained within a clutch housing 336. Finally, the load from end plate 332 is transferred through the tension bar 334 to another end plate (not shown), pressing against an opposing window casement at the idler end of the mounting system.

As the short adjustment mechanism is tightened through the worm, the normal force of the assembly 330 may increase to a point that will cause the slip clutch 354 to slip at a pre-determined force. This feature protects the blinds or window casement from any damage due to excessive tensioning of the blinds system. The operation of the slip clutch also will signal to the user to stop tensioning the short adjustment mechanism 330. A spring 340 is included to absorb axial play from temperature changes and vibrations. In an embodiment, the end-plate 332 swivels around a joint, to accommodate uneven window casements.

The above disclosed embodiments provide a mounting system for a roller blind, in which a mechanism for raising and lowering a window covering rolled around a roller tube includes a clutch. The roller tube is hollow and the clutch includes a central recess, i.e., the clutch includes a hollow center. A tension bar extends through the hollow roller tube and the central recess of the clutch. In alternative embodiments, the mounting system with tension bar can be used with other window covering systems, i.e., systems for spreading and retracting a window covering. In one embodiment, in lieu of a hollow roller tube, the window covering system includes a headrail, and a mechanism associated with the headrail for spreading and retracting a window covering. The window covering system includes a continuous cord loop extending below the headrail for actuating the mechanism to spread and retract the window covering, wherein this mechanism includes a clutch that engages the continuous cord loop. Rather than extending through a hollow roller tube, the tension bar extends through the headrail, and through a central recess of the clutch. End members are coupled to opposite ends of the tension bar, to frictionally engage first and second sides of the window frame. The window covering system with headrail may incorporate a long adjustment mechanism for adjusting the length of the tension bar, and/or may incorporate a short adjustment mechanism for adjusting the width between the end members over a short distance, as described above.

While various aspects and embodiments have been disclosed, other aspects and embodiments are contemplated. The various aspects and embodiments disclosed are for purposes of illustration and are not intended to be limiting, with the true scope and spirit being indicated by the following claims. The foregoing method descriptions are provided merely as illustrative examples and are not intended to require or imply that the steps of the various embodiments must be performed in the order presented. As will be appreciated by one of skill in the art the steps in the foregoing embodiments may be performed in any order. Words such as "then," "next," etc. are not intended to limit the order of the steps; these words are simply used to guide the reader through the description of the methods.

What is claimed is:

1. A mounting system for a roller blind, the roller blind including a roller tube with a window covering rolled around the roller tube, and a mechanism associated with the roller tube for raising and lowering the window covering and including a first clutch and a continuous cord loop engaged by the first clutch, wherein the roller tube is hollow and the first clutch includes a central recess, the mounting system comprising:

- a first mounting fixture including a first end member mountable to a first side of a window frame;
- a second mounting fixture including a second end member mountable to a second side of the window frame;
- a tension bar extending completely through the hollow roller tube and the central recess of the first clutch and extending between the first end member and the second end member, and non-rotatably coupled to the first mounting fixture and to the second mounting fixture;
- a long adjustment mechanism configured to adjust a length of the tension bar to a first length approximately corresponding to a width between the first side of the window frame and the second side of the window frame; and
- a short adjustment mechanism configured to adjust the length of the tension bar to a second length wherein the first end member engages a first inner surface at the first side of the window frame and the second end member engages a second inner surface at the second side of the window frame to mount the roller blind under pressure between the first side of the window frame and the second side of the window frame.

2. The mounting system of claim 1, wherein the short adjustment mechanism is configured to adjust the length of the tension bar from the first length to the second length.

3. The mounting system of claim 1, wherein the short adjustment mechanism is configured to adjust the length of the tension bar to the second length wherein the first end member frictionally engages the first inner surface at the first side of the window frame and the second end member frictionally engages the second inner surface at the second side of the window frame.

4. The mounting fixture of claim 3, wherein the first end member is a first end pad for frictionally engaging the first inner surface at the first side of the window frame and dampening the force of the mounting system against the window frame, and the second end member is a second end pad for frictionally engaging the second inner surface at the second side of the window frame and dampening the force of the mounting system against the window frame.

5. The mounting system of claim 1, wherein the tension bar is a load-bearing bar.

6. The mounting system of claim 1, wherein the short adjustment mechanism includes an external actuating implement.

7. The mounting system of claim 1, wherein the long adjustment mechanism includes an external actuating implement.

8. The mounting system of claim 1, wherein the first end member of the first mounting fixture comprises an end plate, and wherein the short adjustment mechanism comprises:

a compression spring coupled to the tension bar and the end plate, and a locking mechanism including a locked position in which the compression spring is compressed and the end plate is retracted, and an unlocked position in which the compression spring is released and the end plate is extended to press against the first side of the window frame.

9. The mounting system of claim 8, wherein the locking mechanism comprises: a spring release body;

a launch pin coupled to the end plate and the compression spring and movable between the locked position in which the launch pin is retracted into the spring release body, and the unlocked position in which the launch pin is extended from the spring release body;

a locking pin movable between a first configuration and a second configuration; and a second compression spring that biases the locking pin toward the first configuration, wherein in the first configuration the locking pin retains the launch pin in the locked position, and in the second configuration the locking pin disengages the launch pin to release the compression spring and the launch pin to extend to the unlocked position.

10. The mounting system of claim 1, wherein the short adjustment mechanism comprises:

a screw coupling the tension bar to the first mounting fixture, wherein turning the screw continuously displaces the first mounting fixture relative to the tension bar;

a rotatable actuator; and a gear system that transfers torque from the rotatable actuator to turn the screw.

11. The mounting system of claim 1, wherein the first end member of the first mounting fixture comprises an end plate, and wherein the short adjustment mechanism comprises:

a threaded shaft fixed to the end plate;

a slip clutch, wherein rotation of the slip clutch displaces the threaded shaft and the end plate; and a worm gear system rotatably coupled to the slip clutch.

12. The mounting system of claim 1, wherein the tension bar is comprised of a male tension bar slidably coupled within a female tension bar, and wherein the long adjustment mechanism is configured to displace the male tension bar relative to the female tension bar, and to lock the male tension bar within the female tension bar to adjust the length of the tension bar to the first length approximately corresponding to the width between the first side of the window frame and the second side of the window frame.

13. The mounting system of claim 12, wherein the female tension bar includes slots at a plurality of stop positions spaced along the female tension bar; the male tension bar includes a compressible member; and the male tension bar is rotatably mounted within the female tension bar between a first axial orientation in which the compressible member compresses and slides freely within the female tension bar, and a second axial orientation in which the compressible member expands into one of the slots to lock the male tension bar at one of the stop positions spaced along the female tension bar.

14. The mounting system of claim 12, wherein the male tension bar includes a pull rod mounted for displacement within the male tension bar, and a conical expander mechanism that expands to wedge against an inner wall of the female tension bar to lock the male tension bar within the female tension bar upon displacement of the pull rod within the tension bar.

15. The mounting system of claim 12, wherein the female tension bar includes a plurality of ridges defining detent positions spaced along the length of the female tension bar; wherein the male tension bar is a profiled push bar that supports ball bearings; the male tension bar is biased by a compression spring within the female tension bar wherein the profiled push bar forces the ball bearings outward in one of the detent positions to lock the male tension bar within the female tension bar; and wherein upon displacement of the male tension bar to compress the compression spring, the profiled push bar permits inward movement of the ball bearings and permits sliding of the male tension bar within the female tension bar.

16. A roller blind, comprising:

a roller tube with a window covering rolled around the roller tube;

a mechanism associated with the roller tube for raising and lowering the window covering including a clutch and a continuous cord loop having a loop end adjacent the clutch, wherein the roller tube is hollow and the clutch includes a central recess;

a first mounting fixture including a first end member mountable to a first side of a window frame;

a second mounting fixture including a second end member mountable to a second side of the window frame;

a tension bar extending completely through the hollow roller tube and the central recess of the first clutch and extending between the first end member and the second end member, wherein the tension bar is non-rotatably coupled to the first mounting fixture and to the second mounting fixture;

a long adjustment mechanism configured to adjust a length of the tension bar to a first length approximately corresponding to a width between the first side of the window frame and the second side of the window frame; and a short adjustment mechanism configured to adjust the length of the tension bar from the first length to a second length wherein the first end member engages a first inner surface at the first side of the window frame and the second end member engages a second inner surface at the second side of the window frame to mount the roller blind under pressure between the first side of the window frame and the second side of the window frame.

17. The roller blind of claim 16, wherein the first end member of the first mounting fixture comprises an end plate, and wherein the short adjustment mechanism comprises:

a compression spring coupled to the tension bar and the end plate, and a locking mechanism including a locked position in which the compression spring is compressed and the end plate is retracted, and an unlocked position in which the compression spring is released and the end plate is extended to press against the first side of the window frame.

18. The roller blind of claim 16, wherein the tension bar is comprised of a male tension bar slidably coupled within a female tension bar, and wherein the long adjustment mechanism is configured to displace the male tension bar relative to the female tension bar, and to lock the male tension bar within the female tension bar to adjust the length of the tension bar to the first length approximately corresponding to the width between the first side of the window frame and the second side of the window frame.

19. A window covering system, comprising:

a headrail including a mechanism for extending and retracting a window covering;

a clutch associated with the mechanism for extending and retracting the window covering, wherein the clutch includes a central recess;

a tension bar extending through the headrail and the central recess of the clutch;

a first mounting fixture including an end plate non-rotatably coupled to the tension bar and mountable to a first side of a window frame;

a second mounting fixture including a second end member non-rotatably coupled to the tension bar and mountable to a second side of the window frame;

a long adjustment mechanism configured to adjust a length of the tension bar to a first length approximately corresponding to a width between the first side of the window frame and the second side of the window frame; and a short adjustment mechanism configured to adjust the length of the tension bar to a second length wherein the end plate frictionally engages a first inner surface at the first side of the window frame and the second end member frictionally engages a second inner surface at the second side of the window frame for mounting under pressure to the window frame; the short adjustment mechanism comprising a compression spring coupled to the tension bar and the end plate, and a locking mechanism including a locked position in which the compression spring is compressed and the end plate is retracted, and an unlocked position in which the compression spring is released and the end plate is extended to press against the first inner surface at the first side of the window frame.

* * * * *